US007444776B2

(12) United States Patent
Adams

(10) Patent No.: US 7,444,776 B2
(45) Date of Patent: Nov. 4, 2008

(54) VERTICAL LIFT MOUNT APPARATUS FOR FIREARM ACCESSORIES

(76) Inventor: Steve Adams, 12831 W. Beaverlake Dr., Homer Glen, IL (US) 60491

( * ) Notice: Subject to any disclaimer, the term of this patent is extended or adjusted under 35 U.S.C. 154(b) by 147 days.

(21) Appl. No.: 11/377,069

(22) Filed: Mar. 16, 2006

(65) Prior Publication Data

US 2007/0033852 A1 Feb. 15, 2007

Related U.S. Application Data

(60) Provisional application No. 60/706,889, filed on Aug. 10, 2005.

(51) Int. Cl.
*F41G 1/387* (2006.01)

(52) U.S. Cl. ..... 42/127; 42/124

(58) Field of Classification Search ..... 42/124, 42/127

See application file for complete search history.

(56) References Cited

U.S. PATENT DOCUMENTS

| | | | | |
|---|---|---|---|---|
| 2,526,816 | A | 10/1950 | Hardgrove | |
| 2,528,080 | A | 10/1950 | Robertson | |
| 2,539,008 | A | 1/1951 | Brookhyser | |
| 2,580,246 | A * | 12/1951 | Schall | 42/127 |
| 2,649,779 | A | 8/1953 | Hardgrove et al. | |
| 2,767,473 | A | 10/1956 | Craven | |
| 2,857,675 | A | 10/1958 | Kesselring | |
| 3,324,558 | A | 6/1967 | Hart | |
| 3,579,840 | A | 5/1971 | Heinzel | |
| 3,750,318 | A | 8/1973 | Burris | |
| 3,880,389 | A | 4/1975 | Burris | |
| 3,986,285 | A | 10/1976 | Krisay | |
| 4,085,511 | A | 4/1978 | Kovac | |
| 4,121,363 | A | 10/1978 | York | |
| 4,161,076 | A | 7/1979 | Snyder | |
| 4,168,588 | A | 9/1979 | Snyder | |
| 4,205,473 | A | 6/1980 | Wilson | |
| 4,341,022 | A | 7/1982 | Santoro | |

(Continued)

FOREIGN PATENT DOCUMENTS

| | | |
|---|---|---|
| GB | 752966 | 7/1956 |

(Continued)

*Primary Examiner*—Bret Hayes
(74) *Attorney, Agent, or Firm*—McDermott Will & Emery LLP

(57) ABSTRACT

The invention provides a mounting apparatus for releasably securing an accessory to a firearm. The mounting apparatus includes a coupler connectable to the accessory and having a tapered plug with a slot that extends inward from an outer wall of the plug. The apparatus further includes a support base with an internal cavity extending between opposed side walls of the base. The support base has an aperture with an internal wall arrangement including an orifice wherein the aperture is dimensioned for reception of the plug. A keeper is slidably positioned within the internal cavity and has a finger that extends through the orifice and into the slot to retain the plug within the aperture. The apparatus is moveable between a secured position wherein the keeper finger extends through the orifice and into the slot of the plug positioned within the aperture, a released position wherein the keeper finger is disengaged from the orifice, and a detached position wherein the coupler and the accessory are removed from the base by applying a vertical lifting force.

20 Claims, 16 Drawing Sheets

U.S. PATENT DOCUMENTS

| | | | | | |
|---|---|---|---|---|---|
| 4,446,644 | A | | 5/1984 | Jimenez et al. | |
| 4,501,071 | A | | 2/1985 | Manske | |
| 4,539,769 | A | | 9/1985 | Stevens et al. | |
| 4,571,870 | A | | 2/1986 | Heideman et al. | |
| 4,707,772 | A | | 11/1987 | Jimenez et al. | |
| 4,776,126 | A | | 10/1988 | Williams | |
| 4,835,895 | A | | 6/1989 | Bowen | |
| 4,894,941 | A | | 1/1990 | Karow, Jr. | |
| 5,035,487 | A | | 7/1991 | Herz | |
| 5,144,752 | A | | 9/1992 | Boeke et al. | |
| 5,155,915 | A | | 10/1992 | Repa | |
| 5,274,941 | A | | 1/1994 | Moore | |
| 5,353,539 | A | | 10/1994 | Zeh | |
| 5,390,419 | A | * | 2/1995 | Sirkis | 42/127 |
| 5,428,915 | A | | 7/1995 | King | |
| 5,685,105 | A | | 11/1997 | Teetzel | |
| 5,771,622 | A | | 6/1998 | Koziuk et al. | |
| 5,787,630 | A | | 8/1998 | Martel | |
| 6,115,952 | A | | 9/2000 | Rigler | |
| 6,449,893 | B2 | | 9/2002 | Spinner | |
| 6,594,938 | B2 | * | 7/2003 | Horton | 42/127 |
| 6,629,381 | B1 | | 10/2003 | Keng | |
| 6,705,037 | B2 | | 3/2004 | Van Kirk | |
| 6,874,269 | B2 | * | 4/2005 | Chen et al. | 42/85 |
| 6,886,228 | B1 | | 5/2005 | Yocum et al. | |
| 2003/0056417 | A1 | * | 3/2003 | Horton | 42/124 |
| 2004/0139644 | A1 | * | 7/2004 | Murello | 42/85 |
| 2005/0039369 | A1 | | 2/2005 | Wilson | |
| 2006/0010758 | A1 | * | 1/2006 | Zeh | 42/124 |

FOREIGN PATENT DOCUMENTS

| | | |
|---|---|---|
| GB | 1183187 | 3/1970 |
| WO | WO 92/07230 | 4/1992 |
| WO | WO 96/37749 | 11/1996 |

* cited by examiner

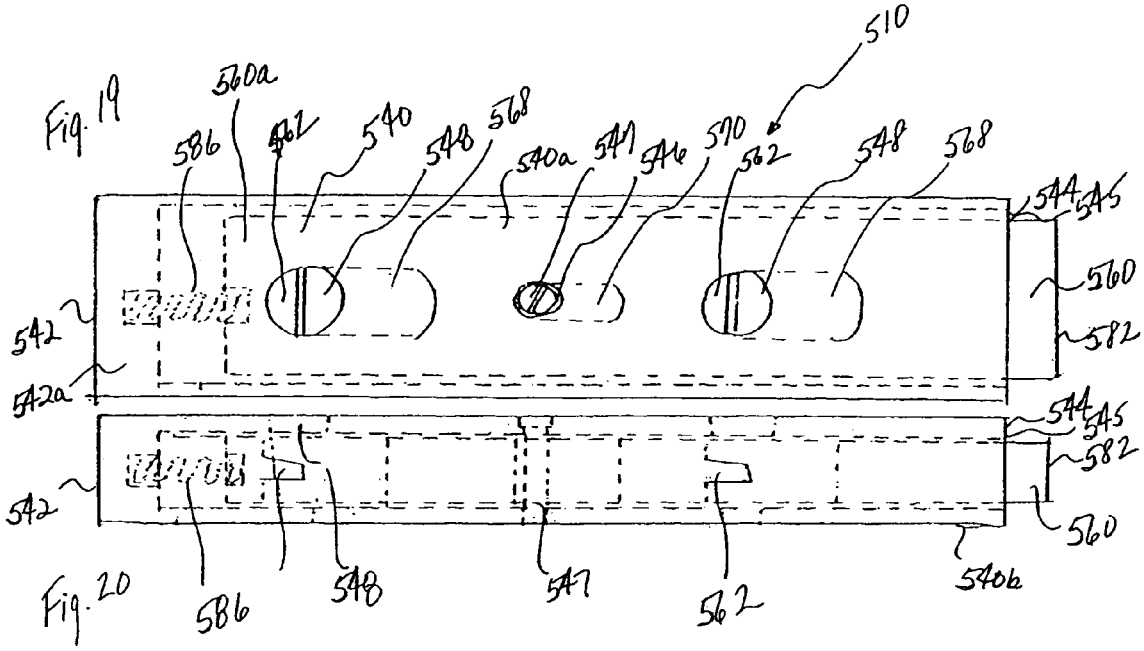
Fig. 19
Fig. 20
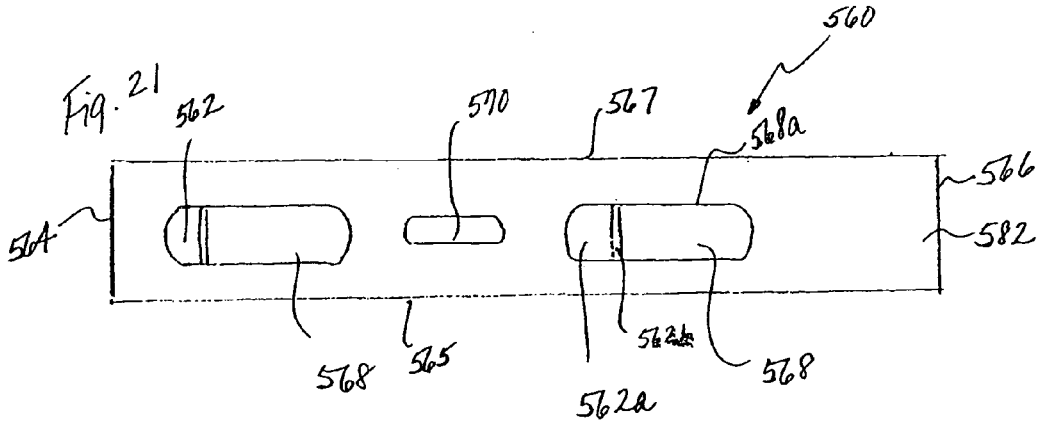
Fig. 21

VERTICAL LIFT MOUNT APPARATUS FOR FIREARM ACCESSORIES

CROSS-REFERENCE TO RELATED APPLICATIONS

This application claims priority from U.S. Provisional Patent Application No. 60/706,889, filed Aug. 10, 2005, which application is incorporated herein by reference and made a part hereof.

FEDERALLY SPONSORED RESEARCH OR DEVELOPMENT

Not applicable.

TECHNICAL FIELD

The invention relates to an accessory mounting apparatus for a firearm that provides for rapid interchangeability of multiple accessories. The mounting apparatus further provides for vertical movement of the accessory during detachment and does not involve pivoting or rotation of the accessory.

BACKGROUND OF THE INVENTION

There currently exists a number of accessory mounting systems for firearms that removably secure the accessory to the firearm. Conventional mounting systems typically include an accessory interface or ring, a block that is affixed to the firearm and to which the accessory interface is secured, and a control knob or level that is actuated to connect the interface to the block. Most conventional mounting systems require angular movement, or pivoting, of the accessory and the interface for coupling with the block to secure the accessory to the firearm. The control knob or lever is then actuated to lock the accessory in place. After the control knob is re-actuated, a second pivotal movement is required to remove the interface and the accessory from the firearm. The structure of conventional mounting systems limits the utility and/or effectiveness of the system in many ways. First, the movements between a secured position and a released position can be time consuming and require the operator to use two hands. Second, the angular or pivotal movement of the accessory during insertion and removal can cause the accessory to contact the firearm, thereby limiting the dimensions of the accessory. In the context of a scope, flashlight, laser sights, etc., limiting the dimensions of the accessory can negatively affect its performance characteristics. Third, the actual securement of the accessory to the block requires actuation of the control knob or lever, which is time consuming and subject to wear over time. Fourth, when the accessory, such as a scope, is removed, the firearm's original sights cannot be utilized since the block is so large that it obstructs the sights. Fifth, the conventional mounting systems contain a significant number of components and moving parts that increase the complexity of operation, as well as increasing the material and manufacturing costs.

One example of a conventional mounting system is disclosed in U.S. Pat. No. 6,594,938 to Horton. There, the mounting system requires angular or pivotal movement of the scope with respect to the firearm for insertion (see FIG. 10) and a similar pivotal movement of the scope for removal (see FIG. 11). As a result of the pivotal movement, the scope is prone to making contact with the firearm. If the size of the scope is increased, meaning the diameter of the scope bells are increased to increase the optical power of the scope, then the scope bells will make contact with the firearm. The contact of the scope bells with the firearm limits the movement necessary for insertion and removal. In the event the scope bells exceed a critical dimension, such as the bell diameter, then the contact between the scope bells and the firearm will preclude the rotational movement needed for insertion and removal. Consequently, the required pivotal movement prevents the mounting system from affixing large-sized accessories to a firearm.

Another example of a conventional mounting system is disclosed in U.S. Pat. No. 5,035,487 to Herz. There, the scope 10 includes a pair of depending studs 14 that are received within a support block 12, wherein the block 12 includes a pair of rotating shafts 16 that secure the studs 14. Each rotating shaft 16 includes a groove 34 that is selectively positioned with respect to a complimentary groove 28 of the stud 14. In an unlocked position (see FIG. 5), the shaft groove 34 is received within the stud groove 28. Conversely, in a locked position (see FIG. 6), the shaft groove 34 faces away from the stud groove 28. An operator rotates each shaft 16 by applying a rotational force to the shaft lever 38 or the slot 52 in the shaft head 36. Therefore, movement between the unlocked and locked positions requires the operator to perform the time consuming step of separately actuating each shaft 34.

The present invention is provided to solve the problems discussed above and other problems, and to provide advantages and aspects not provided by prior firearm accessory mounting systems. A full discussion of the features and advantages of the present invention is deferred to the following detailed description, which proceeds with reference to the accompanying drawings.

SUMMARY OF THE INVENTION

The present invention is directed to a mounting apparatus for releasably securing an accessory to a firearm. The mounting apparatus includes an accessory coupler, a support base, a keeper and a release assembly with an actuator. The mounting apparatus is moveable between a secured position, a released position and a detached position whereby the accessory is removed from the firearm through a vertical lifting force.

According to an aspect of the invention, the coupler is connectable to the accessory and has a plug extending from a main body portion. The coupler includes an upper ring segment and a lower ring segment that collectively define a receiver for engaging an outer surface of the accessory. The plug has a slot that extends inward from an outer wall of the plug and that receives an extent of the keeper. In one embodiment, the plug has a downward taper whereby the diameter of an upper portion of the plug is greater than the diameter of a lower portion of the plug.

According to another aspect of the invention, the support base has an internal cavity extending between opposed side walls of the base. The support base has at least one aperture with an internal wall arrangement including an orifice. The aperture is in communication with the internal cavity and is cooperatively dimensioned with the plug for its reception. Like the plug, the aperture has a downward taper whereby the diameter of an upper portion of the aperture is greater than the diameter of a lower portion of the aperture.

According to yet another aspect of the invention, the keeper is slidably positioned within the internal cavity. The keeper has a finger that extends through the orifice and into the slot to retain the plug within the aperture. Preferably, the number of fingers corresponds to the number of apertures and the plugs received therein.

According to another aspect of the invention, the release assembly includes an actuator operably connected to the keeper, wherein the application of a release force to the actuator displaces the finger from the slot thereby permitting removal of the plug from the aperture. A biasing means, such as a spring, is positioned between the actuator and an internal wall of the base.

The mounting apparatus of the present invention provides a number of benefits over the prior art, including vertical, non-pivoting, detaching movement that prevents contact with the firearm and does not limit the accessory size, a return to optical zero when the accessory is connected to the base, positive engagement or "snapping" into the secured position, and interchangeable couplers that provide for securement for an entire family of optical devices and attachments, such as scopes, laser sights, rangefinders, night vision, and flashlights.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 23 is a top plan view of an alternate firearm accessory mounting apparatus;

FIG. 19 is a top plan view of the mounting apparatus of FIG. 18, showing hidden structure in broken lines;

FIG. 20 is a side view of the mounting apparatus of FIG. 18, showing hidden structure in broken lines;

FIG. 21 is a top plan view of a keeper of the mounting apparatus of FIG. 18; and, FIG. 22 is a perspective view of the mounting apparatus of FIG. 18.

DETAILED DESCRIPTION

Figure 1:
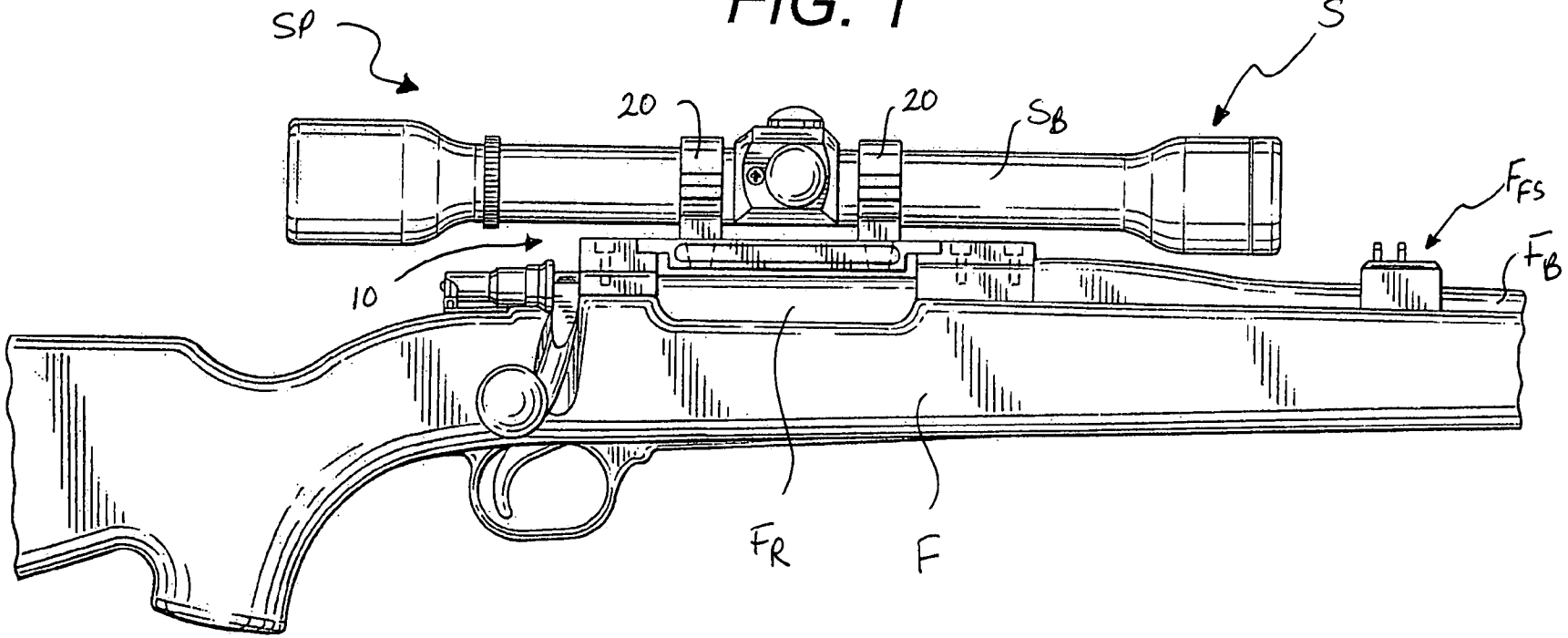
FIG. 1 is a perspective view of the firearm accessory mounting apparatus of the invention, showing the mounting apparatus removably securing a scope to a firearm to define a secured position.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-17 depict a firearm accessory mounting apparatus of the invention. The mounting apparatus 10 is configured to removably secure an accessory, such as an optical scope S, a laser or laser aiming module (LAM), a flashlight, a range finder, or a night vision scope to a firearm F. As explained below, the mounting apparatus 10 includes unique components that enable the accessory, for example the scope S, to be moved between a secured position SP (see FIG. 1) wherein the scope S is secured to the firearm F, a released position RP (see FIG. 5B), and a detached position DP (see FIG. 2) wherein the scope S is removed from the firearm F by the application of a vertical lifting force upon the scope S. Once the detached position DP is reached, a second scope S or a different accessory, such as a flashlight, can be affixed to the firearm F without recalibrating the mounting apparatus 10 and/or the firearm F from the initial calibrations made for the first scope S. In this manner, the apparatus 10 allows for the rapid and precise interchangeability of various accessories to the firearm F without compromising the operation and accuracy of the firearm F. Where scopes and other optical devices are the interchanged accessories, the apparatus 10 provides optical zero for each accessory thereby eliminating the time consuming steps of adjusting the firearm and/or the accessory sights for windage and elevation to reach optical zero. One of skill in the art recognizes that optical zero results from the sighting process where the sights are adjusted to account for windage and elevation. In contrast to conventional devices, the accessory is moved to the detached position DP with a purely vertical movement that does not require pivoting of the scope S, or the actuation of a rotary knob or levers to detach the scope S from the firearm F. In further contrast with conventional devices, when the accessory, such as the scope S is detached, the shooter can still utilize the firearm's front sights $F_{FS}$ (see FIG. 1) that extend upward from the firearm barrel $F_B$ to aim the firearm F before firing a round. The mounting apparatus 10 comprises at least one accessory coupler 20, a base 40, a keeper 60, and a release assembly 80.

The coupler 20 is connected to the accessory and includes structure that is received by the base 40 to removably secure the accessory to the firearm F. Where the accessory is the scope S, the coupler 20 is a ring assembly 21 that includes an upper ring segment 22 and a lower ring segment 24. The upper and lower rings segments 22, 24 are joined with a fastener 26 to define a receiver 28 that securedly receives a body portion $S_B$ of the scope S. Preferably, the fastener 26 extends through a flange portion 25 of the ring segments 22, 24. Although shown as having a circular periphery, the receiver 28 can have other configurations to engage the accessory. For example, the receiver 28 can have a U-shaped or V-shaped configuration to cradle an extent of the accessory. A liner 29 can be positioned within the receiver 28 to minimize the chance that the ring segment 22, 24 scratches the exterior surface of the accessory. As shown in FIGS. 5 and 6, the lower ring segment 24 includes a body portion 30 with a depending elongated plug 32. The plug 32 has a sloped outer wall arrangement 32*a* which results in the plug 32 being tapered. Preferably, the plug 32 is downwardly tapered such that the diameter of the plug 32 at an upper plug portion 32*b* is greater than the diameter at a lower plug portion 32*c*. A generally horizontal wall 31 is positioned at an upper portion of the plug 32 wherein the wall 31 engages an upper surface 40*a* of the base 40 in the secured position SP. The plug 32 further includes a slot 34 that extends inward from the side wall 32*a*. The slot 34 includes a horizontal upper wall 34*a*, a vertical internal wall 34*b*, and lower wall 34*c* which can be angled. An angled shoulder 36 is positioned between the slot 34 and an end wall 38 of the plug 32. The slot 34 has an internal depth measured from the outer wall 32*a* that is approximately half of its diameter. As explained in greater detail below, when the mounting apparatus 10 is in the secured position SP, the plug 32 extends into the base 40 and is securedly engaged by an extent of the keeper 60.

Figure 2:
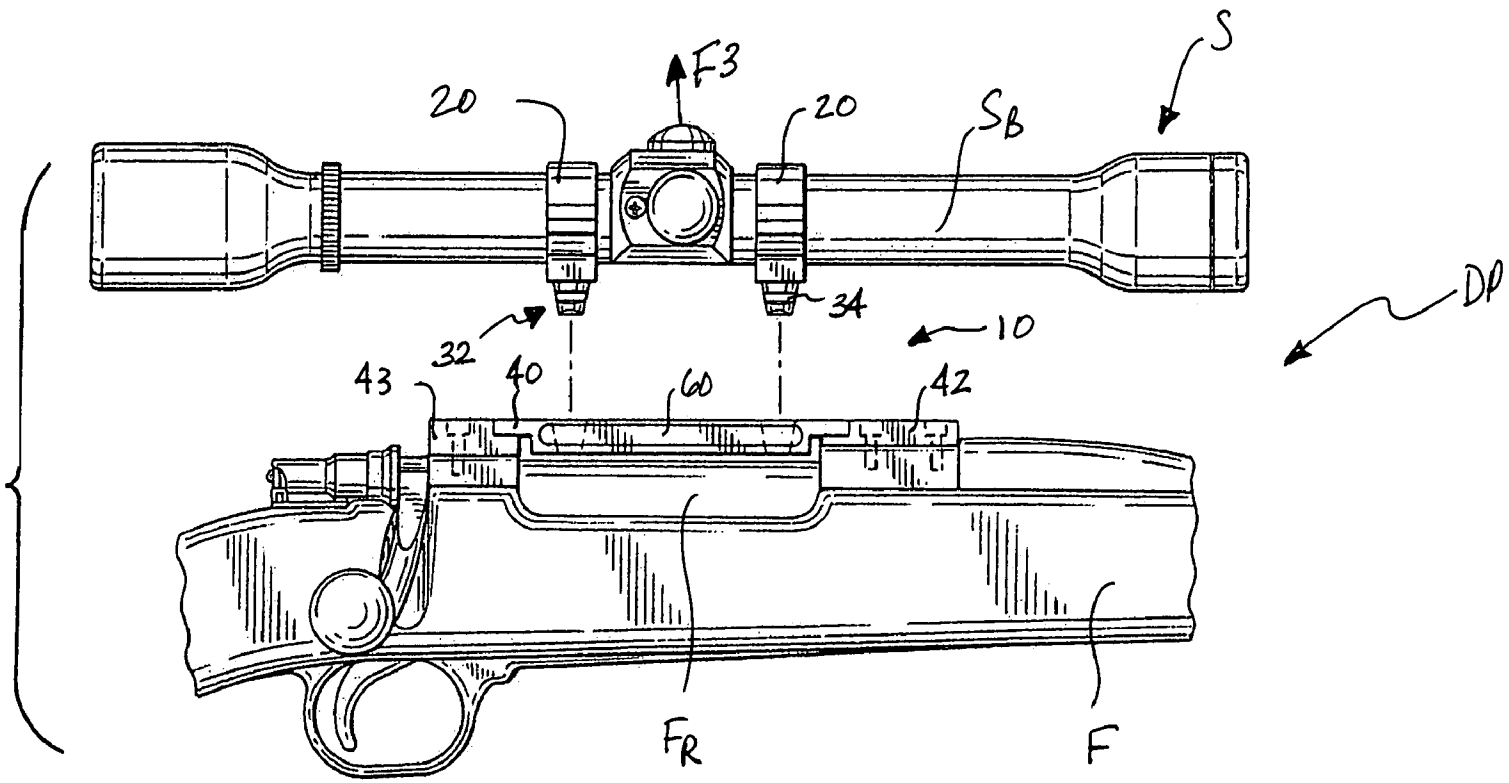
FIG. 2 is a side view of the firearm accessory mounting apparatus of FIG. 1, showing the application of a detaching force to the accessory to move the accessory to a detached position.

Although the ring assembly 21 is shown as having two distinct segments 22, 24, the ring 21 can have a single lower segment 24 that is affixed to the accessory without encircling it as shown in FIGS. 1 and 2. For example, the single segment 24 can be secured to a lower region of the accessory, such as a flashlight or scope. As another example, the segment 24 can be integrally formed with the scope S. In another alternative, the ring segments 22, 24 are omitted and the plug 32 extends directly from the firearm accessory, wherein the plug 32 defines the coupler 20. As examples, a flashlight has a plug 32 that extends from an exterior housing, and a scope S has a plug 32 that extends from the scope body. The accessory may be integrally formed with at least one plug 32 that is receivably secured by the base 40. The plug 32 can have at least one elastomeric gasket or ring that acts to dampen the shock or vibration transmitted from the firearm F to the accessory. The ring(s) can be located above or below the slot 34.

Figure 3:
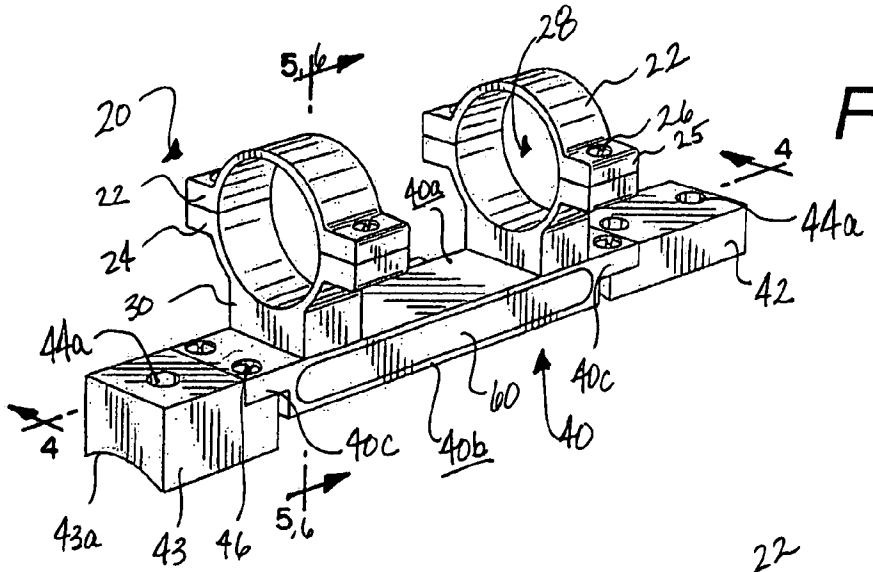
FIG. 3 is a perspective view of the firearm accessory mounting apparatus of FIG. 1.
Figure 4:
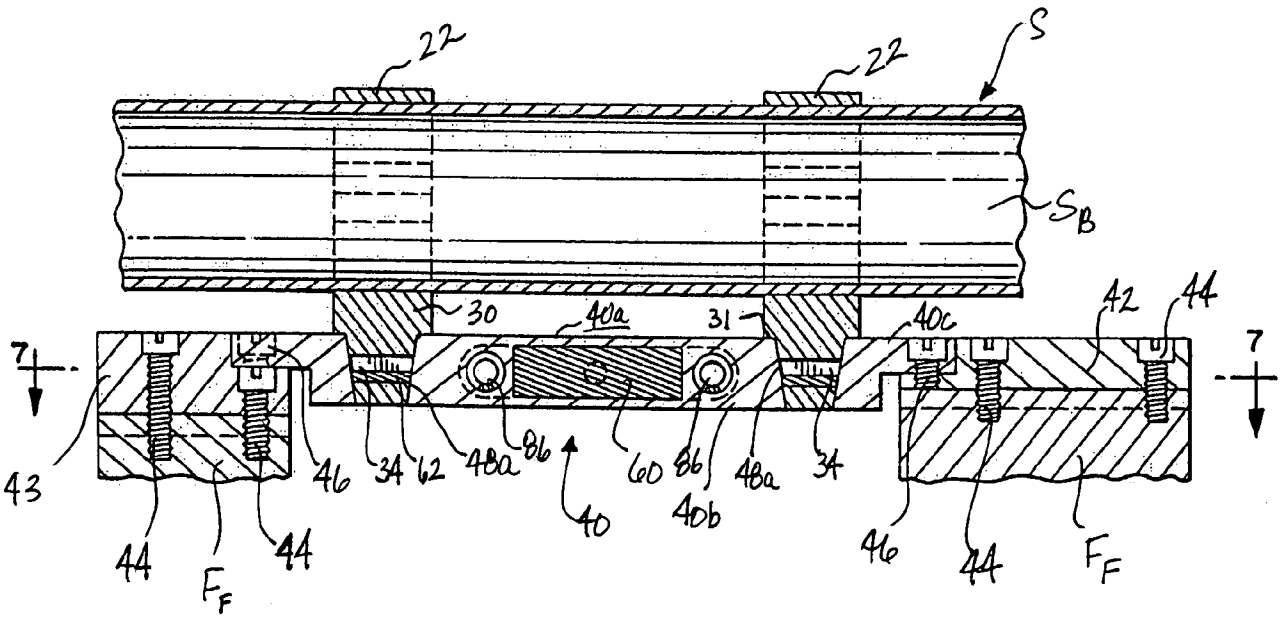
FIG. 4 is a cross-sectional view of the firearm accessory mounting apparatus of FIG. 1 taken along line 4-4 of FIG. 3.
Figure 7:
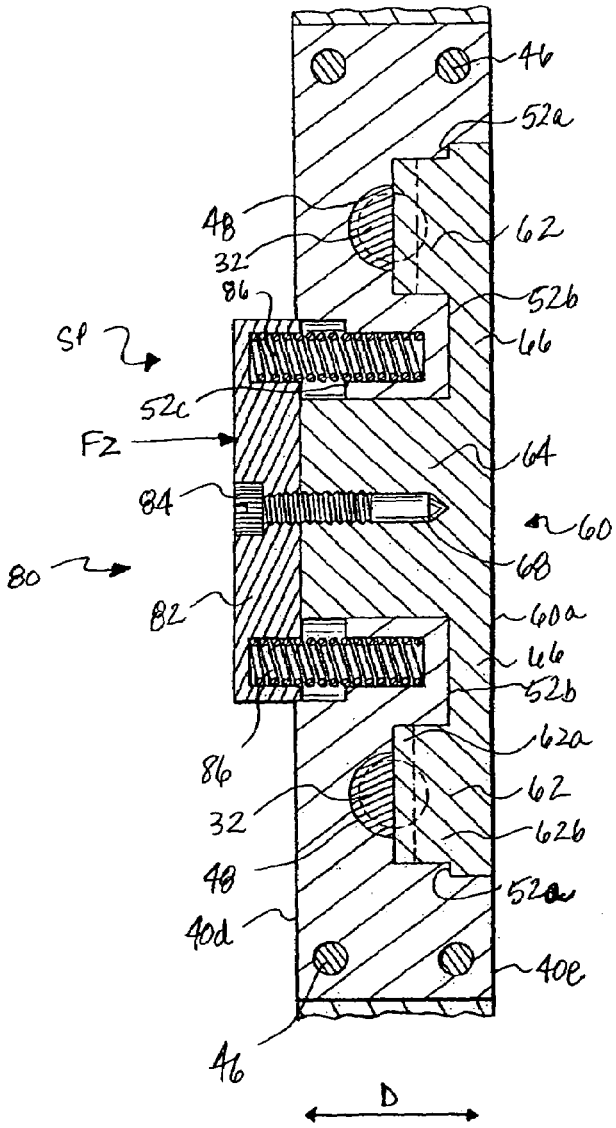
FIG. 7 is a cross-sectional view of the firearm accessory mounting apparatus of FIG. 1 taken along line 7-7 of FIG. 4, showing the apparatus in the secured position.
Figure 9:
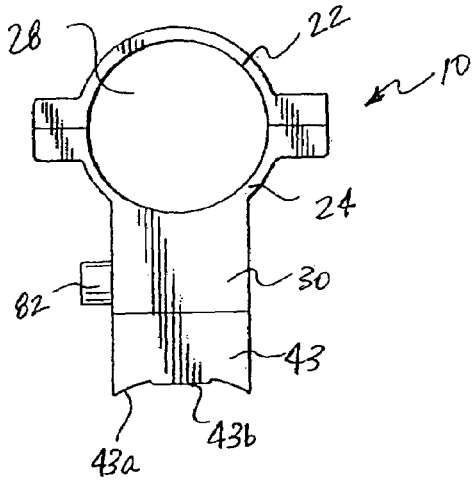
FIG. 9 is an end view of an alternate firearm accessory mounting apparatus suitable for mounting to a shotgun.
Figure 8:
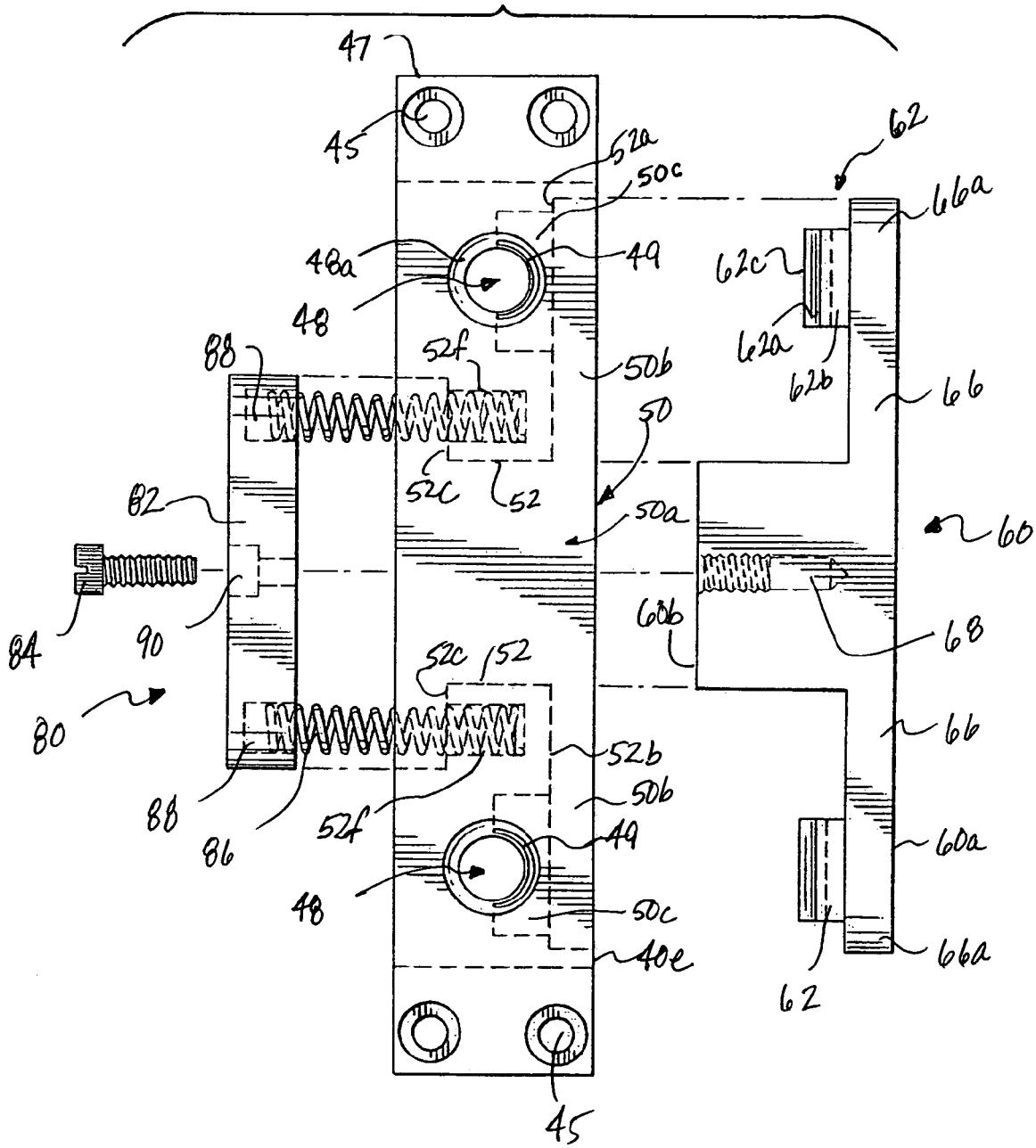
FIG. 8 is an exploded top view of a portion of the firearm accessory mounting apparatus of FIG. 1.

As shown in FIGS. 1 and 2, the base 40 is an elongated support structure that is affixed to the firearm frame $F_F$ by a front mounting tab 42 and a rear mounting tab 43. The base 40 includes the upper surface 40*a* and a main body portion 40*b*. Referring to FIG. 4, at least one fastener 44 that extends through an aperture 44, wherein the fastener 44 secures the mounting tabs 42, 43 to the frame $F_F$ such that the base 40 is positioned above the firearm receiver $F_R$ and peripheral base ledges 40*c* engage the respective mounting tabs 42, 43. Due to the configuration of the mounting apparatus 10, including the base 40 and the tabs 42, 43, the operation of the firearm F is not compromised, including the ejection of a shell or casing from the firearm receiver $F_R$. Referring to FIGS. 3, 7 and 8, the base 40 includes at least one aperture 45 that receives a fastener 46 to secure the base 40 to each mounting tab 42, 43. Referring to FIG. 3, the tab 42, 43 has a bottom wall 43*a* that is dimensioned to engage an upper surface of the firearm F. The bottom wall 43*a* can have a curvilinear configuration which defines a convex or concave firearm engaging surface. Alternatively, the bottom wall 43*a* can have an angled or linear configuration. In another alternative shown in FIG. 9, the tab 43 has a concave bottom wall 43*a* with a centrally positioned rail 43*b*. This configuration is particularly suited for mounting the tab 43 and the apparatus 10 to a shotgun. In another alternative mounting configuration, the base 40 via the tabs 42, 43 is secured to an extent of the barrel $F_B$ near the muzzle, which results in a "scout mount."

Referring to FIGS. 1 and 2, the tabs 42, 43 are configured such that when the accessory is removed, the tabs 42, 43 do not obstruct the shooter from aiming the firearm via the front sights $F_{FS}$ and firing a round. Accordingly, the tabs 42, 43 have a height such that when affixed to the firearm F, neither tab 42, 43 extends above the front sights $F_{FS}$. In one embodiment, the front tab 42 has a height of less than 0.5 inch and the rear tab 43 has a height of less than 0.7 inch. In a preferred embodiment where the apparatus 10 is used in connection with a bolt action rifle, the front tab 42 has a height of less than 0.35 inch and the rear tab 43 has a height of less than 0.55 inch.

The base 40 includes an aperture 48 that is cooperatively dimensioned with the plug 32 for its reception. In one embodiment, the aperture 48 has a tapered configuration with a sloped internal wall arrangement 48*a* wherein the diameter Dl at an upper portion of the aperture 48 is greater than the diameter D2 at a lower portion of the aperture 48. During insertion of the plug 32, the plug's sloped wall 32*a* slidingly engages the aperture's sloped wall 48*a*. The inner surface of the sloped wall 32*a* can be polished or coated with a substance to reduce the coefficient of friction between the wall 32*a* and the plug 32 and to facilitate reception of the plug 32. Referring to FIG. 6, a lower portion of the aperture 48 can include a vertical segment 48*b*. The aperture 48 is shown extending through the base 40; however, the height of the base 40 and/or the aperture 48 can be lessened such that the aperture 48 extends through a substantial extent of the base 40. As shown in FIG. 8, the aperture 48 includes an orifice 49 in the internal wall 48*a* that receives a finger 62 of the keeper 60. Therefore, the orifice 49 is a passageway between the aperture 48 and the internal cavity 50. As explained below, the finger 62 extends through the orifice 49 and is received in the slot 34 of the plug 32. The orifice 49 shown in FIG. 8 has a curvilinear or crescent-shaped configuration when viewed from above. Regardless of its configuration, the orifice 49 is dimensioned to allow at least a leading portion 62*a* of the finger 62 to extend through the orifice 49. Thus, the orifice 49 acts as a passageway for the finger 62 from the cavity 50 into the aperture 48. Although the base 40 is shown in the Figures as having two apertures 48, it can have a single aperture 48 or many apertures 48. In the latter scenario, the apertures 48 can be arranged to form a triangle, whereby legs connecting pairs of the apertures 48 define the triangle. It is understood that numerous apertures 48 could define a square, pentagon or a jagged-saw tooth pattern. A base 40 having many apertures 48 provides a number of options for selectively securing the accessory since the relative positioning of the couplers to the accessory can be selectively adjusted for the dimensions of the accessory. An elastomeric plug (not shown) can be inserted into the unused aperture(s) 48 to prevent the accumulation of moisture and/or foreign matter. Referring to FIG.

6A, the aperture 48 has a longitudinal axis A-A and the plug 32 has a longitudinal axis B-B.

The base 40 further includes an internal cavity 50 that receives an extent of both the keeper 60 and the release assembly 80, depending upon the position of the apparatus 10. As shown in FIG. 8, internal cavity 50 includes a main cavity segment 50*a* that slidingly receives a central portion 64 of the keeper 60 and the actuator 82. As a result, the main cavity segment 50*a* includes an opening in both sides of the base 40. Described in a different manner, the main cavity segment 50*a* extends between a first outer base wall 40*d* and a second outer base wall 40*e* (see FIG. 8). The cavity 50 includes an internal wall arrangement 52 that defines boundaries of the cavity 50. ,The wall arrangement 52 includes a staggered or notched cavity wall 52*a*, a first inner cavity wall 52*b* and a second inner cavity wall 52*c*. The wall arrangement 52, and its components, may engage portions of the keeper 60 and the actuator 80 depending upon their position, and thereby acts as a restriction. The cavity 50 further includes two peripheral segments 50*b* that each receive an arm 66 and finger 62 of the keeper 60. Preferably, each segment 50*b* includes a finger recess 50*c* that extends inward into communication with the aperture 48 via the orifice 49, wherein the finger recess 50*c* receives an extent of the finger 62. As shown in FIG. 8, both the finger recess 50*c* and the finger 62 have a rectangular configuration when viewed from above.

As mentioned above, the keeper 60 is slidingly received within the base 40 by the cavity 50. Referring to FIG. 8, the keeper 60 has a generally T-shaped configuration when viewed from above and is configured to interact with the plug 32 to retain the coupler 20 in the secured position SP. Along those lines, an arm 66 extends outward from the central portion 64 of the keeper 60. Near its outer end 66*a*, the arm 66 has an outwardly extending finger 62. The finger 62 includes the frontal or leading portion 62*a* extending forward from a main body portion 62*b*. While the arm 66 is received within the peripheral segment 50*b*, the finger 62 is received within the finger recess 50*c*. There is a notched or staggered wall 52*a* between the peripheral segment 50*b* and the finger recess 50*c* that, along with the inner cavity wall 52*b*, engages and constrains inward movement of the keeper 60. In a similar manner, the second inner cavity wall 52*c* engages and constrains movement of the actuator 82. Accordingly, the internal cavity 50, including the internal wall arrangement 52, is configured to slidingly receive the keeper 60. In the context of firearms and firearm accessories, the keeper 60 has a height or thickness measured between upper and lower surfaces that ranges from 0.0625 to 0.5 inch, and a preferred height range from 0.125 to 0.25 inch.

Figure 5A:
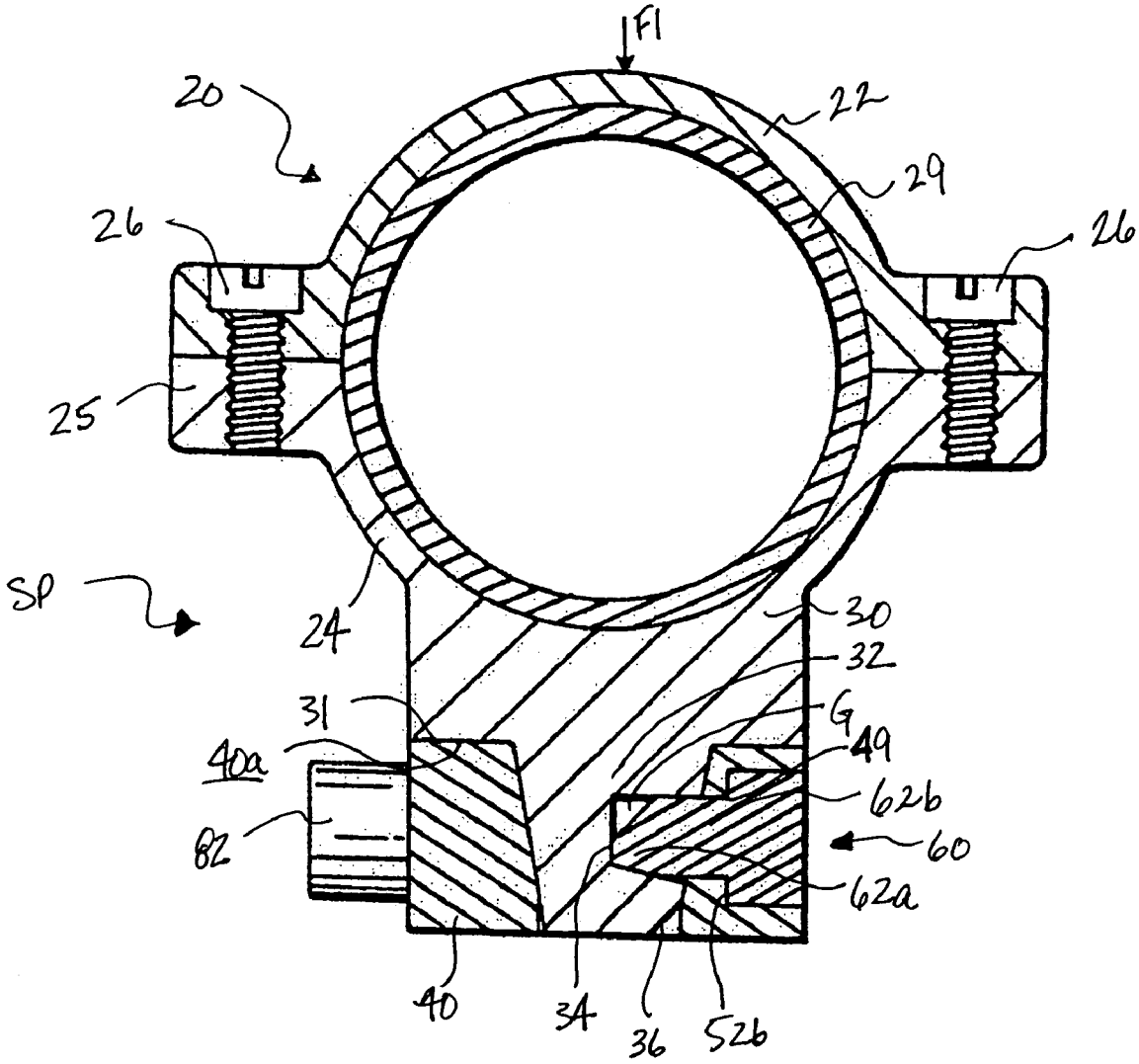
FIG. 5A is a cross-sectional view of the firearm accessory mounting apparatus of FIG. 1 taken along line 5-5 of FIG. 3, showing the apparatus in the secured position.
Figure 5B:
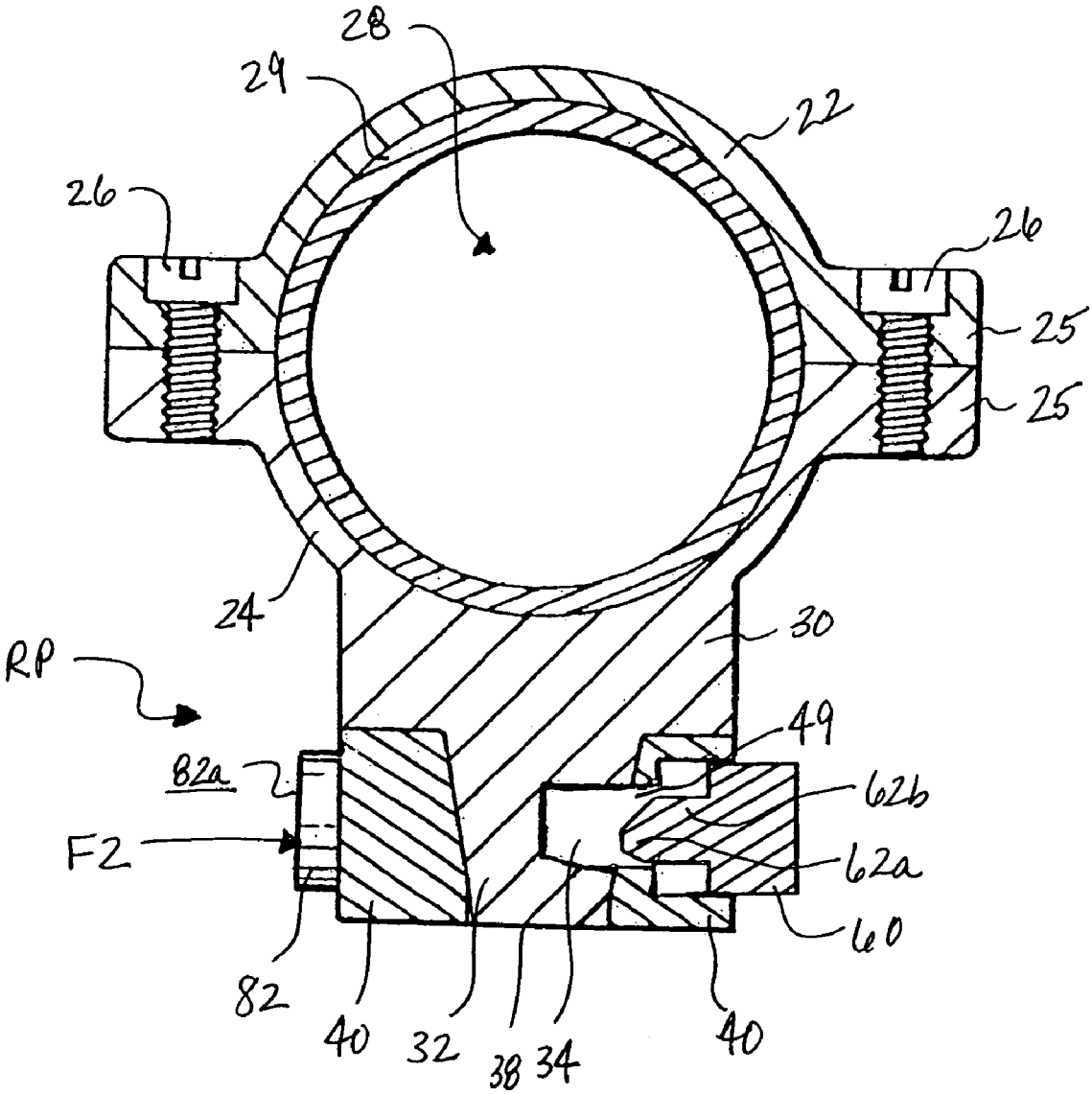
FIG. 5B is a cross-sectional view of the firearm accessory mounting apparatus of FIG. 1 taken along line 5-5 of FIG. 3, showing the apparatus in a released position.
Figure 6A:
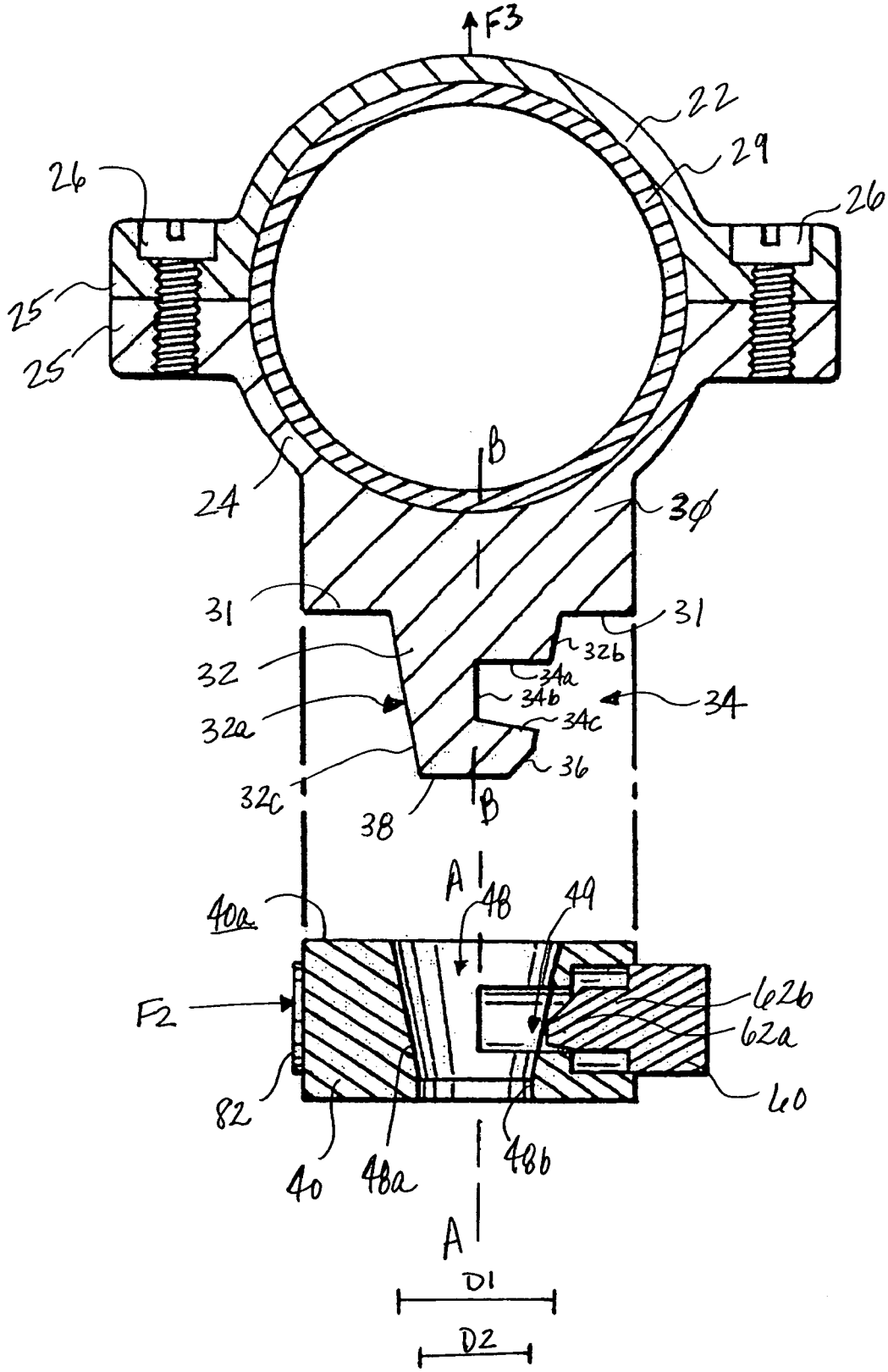
FIG. 6A is a cross-sectional view of the firearm accessory mounting apparatus of FIG. 1 taken along line 6-6 of FIG. 3, showing the apparatus in the detached position.
Figure 6B:
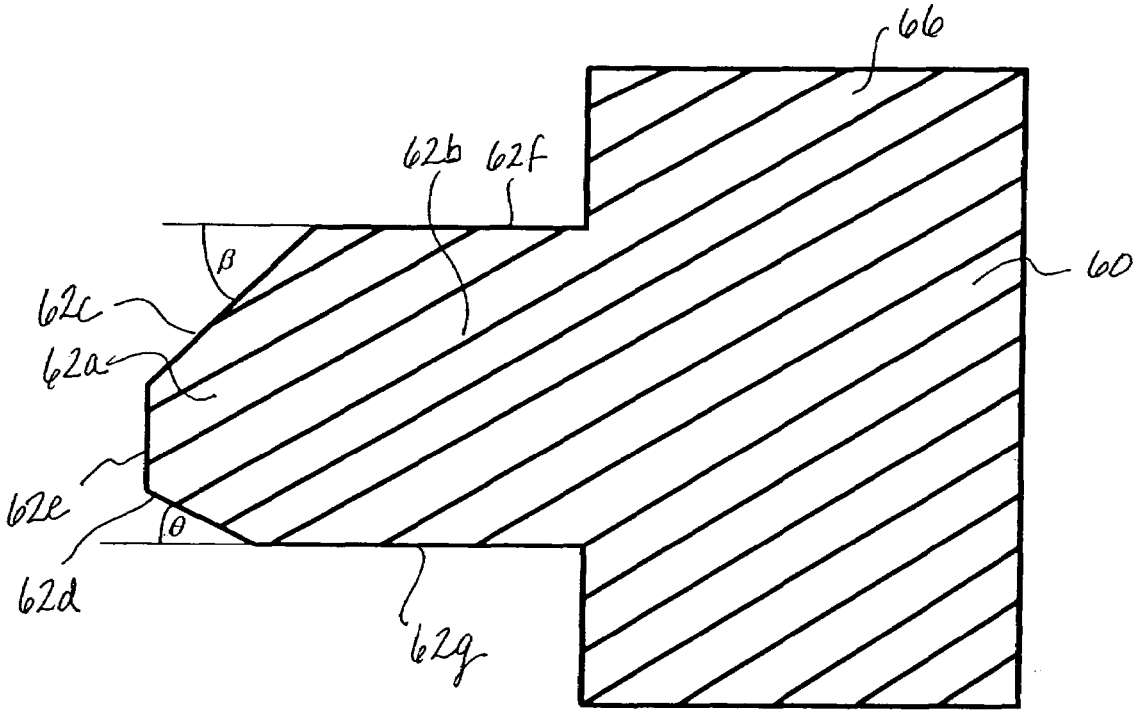
FIG. 6B is a schematic view of the keeper finger of firearm accessory mounting apparatus of FIG. 1.

As shown in FIG. 6B, the leading portion 62*a* includes an upper inclined surface 62*c*, a lower inclined surface 62*d* and a vertical surface 62*e* that extends between the two surfaces 62*c, d*. The upper inclined surface 62*c* is sloped at an angle β to the horizontal that ranges between 30 and 50 degrees, with a preferred angle of approximately 45 degrees. The lower inclined surface 62*d* is sloped at an angle θ to the horizontal that ranges between 5 and 20 degrees, with a preferred angle of approximately 10 degrees. The main body portion 62*b* has an upper surface 62*f* and a lower surface 62*g*. In the released position RP of FIG. 5B, the finger 62 is disengaged from the slot 34 whereby the finger 62 is disassociated with the plug 32. In the secured position SP of FIG. 5A, an extent of the finger 62 is received by the slot 34 to securedly retain the plug 32 within the block 40. In the secured position SP, a clearance or gap G is formed between the plug 32 and the finger 62 in the slot 34. Preferably, the gap G resides proximate an upper portion of the finger 62. The central portion 64 of the keeper 60 has a generally rectangular configuration with an opening 68 that receives a fastener 84 that joins the actuator 82 to the keeper 60. In a preferred embodiment, the number of fingers 62 equals the number of apertures 48 and plugs 32. Therefore, a single keeper 60 engages and locks multiple plugs 32 in the secured position SP to rigidly secure the accessory.

The release assembly 80 includes an elongated actuator member 82, at least one means for biasing the actuator 82, and the fastener 84. The release assembly 80 is designed to be actuated by an operator to allow the apparatus 10 and the accessory to be moved between the secured position SP and the detached position DP. The biasing means can be a spring, such as a helical spring 86 (see FIGS. 7 and 8) or a flat spring. The spring 86 is positioned between the actuator member 82 and the base 40. A first end of the spring 86 is received within a receptacle 50*f* of the block cavity 50, and a second end of the spring 86 is received within a well 88 of the actuator 82. The spring 86 has an axis of operation that is substantially perpendicular to a major axis of the base 40 and a longitudinal axis of the aperture 48. Described in a different manner, the spring 86 exerts a biasing force upon the actuator 82 and the keeper 60 connected thereto in a direction that is substantially perpendicular to a major axis of the base 40 and a longitudinal axis of the aperture 48. The fastener 84 extends through a passageway 90 in the actuator 82 and is received by the opening 68 in the keeper 60 to couple the actuator 82 to the keeper 60. Once coupled, the actuator 82 and the keeper 60 are moveable in the indicated direction D, which represents movement into and out of the cavity 50 of the base 40. The movement D results from the application of an inwardly directed force on the actuator 82, or a downwardly directed force on the plug 32 into the block aperture 48. Described in a different manner, the movement D occurs substantially perpendicular to a vertical axis of the aperture 48 and/or a longitudinal axis of the plug 32.

As mentioned above, the mounting apparatus 10 allows the firearm accessory to be moved between an initial position, the secured position SP (see FIGS. 1, 5A), the released position RP (see FIG. 5B) and the detached position DP (see FIGS. 2, 6A) wherein the accessory can be affixed to and removed from the firearm F. Once the detached position DP is reached, a second accessory, such as a laser aiming module (LAM) having at least one coupler 20 with a depending plug 32, can be quickly affixed to the firearm F with the mounting apparatus 10. In this manner, the apparatus 10 allows the rapid interchangeability of various accessories to the firearm F. Alternatively, the first accessory is removed and not replaced with a second accessory, wherein the shooter can proceed to aim the firearm via the front sights $F_{FS}$ before firing a round. The operation of the apparatus 10, including its components, is described in the following paragraphs.

In an initial position of the apparatus 10, the base 40 is mounted to the firearm F via the tabs 42, 43, and the coupler (s) 20 is affixed to the accessory but not connected to the base 40. Accordingly, the plug 32 is not positioned within the aperture 48 of the base 40. The leading edge 62*a* of the finger 62 extends through the orifice 49 into the aperture 48. However, the leading edge 62*a* merely extends into the aperture 48 and does not engage the plug 32. As explained above, the firearm can be accurately aimed and fired in the initial position since neither the base 40 nor the tabs 42, 43 obstruct use of the firearm's front sights $F_{FS}$. The initial position occurs prior to an accessory being connected to the firearm F and after an accessory is removed from the firearm F.

To reach the secured position SP, the shooter brings the accessory into close proximity to the base 40, wherein a downwardly directed insertion force F1 (see FIG. 5A) is applied to the accessory, for example the scope S, to insert the plug 32 into the aperture 48. Because the keeper 60 is connected to the actuator assembly 80, the insertion force should be large enough to compress the spring 86 which allows for movement of the actuator 82 into the cavity 50 of the base 40. The spring 86 is compressed in a direction that is substantially perpendicular to the major axis of the base 40 and the longitudinal axis A-A of the aperture 48. Provided a sufficient insertion force is applied, the bottom wall 38 of the plug 34 engages the leading edge 62*a* of the finger 62 and displaces the finger 62 from the aperture 48. Specifically, the bottom wall 38 and the shoulder 36 engage the upper inclined surface 62*c* and the vertical surface 62*e* and displaces the finger 62 away from the plug 34. Due to the displacement, the finger 62 moves outward or away from the actuator 82 such that the outer keeper wall 60*a* extends beyond the outer base wall 40*e*. The displacement of the keeper 60 continues until the finger 62 exits the aperture 48 through the orifice 49 thereby creating a clearance for the plug 32 to be received within the aperture 48. Assuming the insertion force is continuously applied, the plug slot 34 and the shoulder 36 clear the leading portion 62*a* which allows the keeper 60 to move inward towards the actuator 82 and away from the outer base wall 40*e*. The inward movement of the keeper 60 results from the biasing force provided by the compressed spring 86 and continues as the finger 62 extends through the orifice 49 and into the plug slot 34. The biasing force provided by the spring 86 to the keeper 60 is oriented substantially perpendicular to the longitudinal axis A-A of the aperture 48 and B-B of the plug 32. Therefore, the keeper 60 moves towards the right (see FIG. 7) and past the outer base wall 40*e* until the clearance sufficient for insertion of the plug 34 in the aperture 48 is achieved. Thereafter, the keeper 60 moves to the left (FIG. 7) causing the finger 62 to extend through the orifice 49 and into the plug slot 34. Accordingly, the keeper 60 and actuator 80 move in a first direction and then a second direction that is opposite the first as the plug 32 is inserted into the aperture 48 to reach the secured position SP. Once the leading edge 62*a* is received by the plug slot 42, the apparatus 10 is in the secured position SP.

In the secured position SP of FIGS. 1, 3-5A and 7, the reception of the plug 32 within the aperture 48 couples the accessory to the firearm F. Referring to FIG. 5A, the finger 62 extends through the orifice 49 and is received by the slot 34 to retain the plug 32 within the aperture 48 and prevent upward movement of the accessory relative to the base 40. Specifically, the leading edge 62*a* resides within the slot 34, and the body portion 62*b* resides within and external to the slot 34. As shown in FIG. 7, the leading edge 62 extends into the slot 34 a substantial amount such that the edge 62*a* approaches a midpoint of the aperture 48. Furthermore, the upper inclined surface 62*c* is spaced a distance from the horizontal upper wall 34*a* and the vertical internal wall 34*b* to define the gap G; the lower inclined surface 62*d* engages the angled lower wall 34*c*; the vertical surface 62*e* engages a lower portion of the vertical internal wall 34*b*; the upper surface 62*f* engages an extent of both the horizontal upper wall 34*a* and the orifice upper wall 49*a*; and, the lower surface 62*g* engages an extent of both the angled lower wall 34*c* and the orifice lower wall 49*b*. Over time and repeated use, portions of the apparatus 10, including the plug 32, the spring 86, the actuator 82, and the keeper 60, may wear; however, this wear does not adversely affect the operation of the apparatus 10 since such wear causes the finger 62, including the lead edge 62*a*, to extend further into the slot 34. For example the angled lower slot wall 34*c* and the lower inclined finger surface 62*d* may wear from the sliding engagement there between, however, such wear enables the spring 86 to bias the lead edge 62*a* of the keeper finger 62 further into the plug slot 34. As a result, the locking engagement between the keeper 60 and the plug 32 is heightened over time and with wear.

Also in the secured position SP, the notched inner wall 52*a* engages an exterior portion of the keeper arm 66, and the inner cavity wall 52*b* engages an interior portion of the keeper arm 66. A first extent of the actuator 82 resides external to the base 40, and a second extent of the keeper 60 resides within the cavity 50. In a preferred embodiment, first keeper side wall 60*a* is aligned with the second outer wall 40*e* of the base 40 and a second keeper side wall 60*b* is positioned slightly inward of the first base outer wall 40*d* (see FIG. 7). The spring 86 is in an unstressed or uncompressed state whereby it does not exert a biasing force on the actuator assembly 80.

To move the apparatus 10 from the secured position SP to the released position RP (See FIG. 5B) which leads to the detached position DP, an inwardly directed releasing force F2 (see FIGS. 5B, 7) is applied to the outer wall 82*a* of the actuator 82 in order to disengage the finger 62 from the plug slot 34. The releasing force F2 compresses the spring 86 and displaces the keeper 60 and the finger 62 away from the aperture 48 such that the outer keeper wall 60*a* extends beyond the outer base wall 40*e*. The displacement of the keeper 60 towards the right (see FIG. 7) continues until the finger 62 exits the aperture 48 through the orifice 49 thereby releasing the leading portion 62*a* from the plug slot 34. Consequently, the finger 62 reaches the released or intermediate position RP wherein the finger 62 is disassociated from the plug 32 and does not prevent removal of the plug 34 from the aperture 48 and the base 40. In the released position RP of FIG. 5B, the leading portion 62*a* is positioned external to the orifice 49 and the sidewall arrangement 48*a* of the aperture 48 whereby the finger 62 does not engage the plug 32 and the operator can then remove the accessory from the base 40. In an alternate version, the leading portion 62*a* is retained within the orifice 49 but does not interact with slot 34 or obstruct the removal of the plug 32.

To remove the accessory and arrive at the detached position DP from the released position RP, an upward detaching force F3 is applied to the accessory and/or the coupler(s) 20. Referring to FIG. 2, the detaching force F3 is a vertical force applied to the scope S whereby the plugs 34 are detached from the aperture 48 and the base 40. Preferably, the detaching force F3 is applied substantially perpendicular to the base 40 and the firearm F. Described in a different manner, the detaching force F3 is applied substantially parallel to a longitudinal axis of the aperture 48. Unlike conventional accessory mounting devices which require pivoting or rotation of the accessory for removal that leads to contact between the accessory and the firearm F, the inventive apparatus 10 provides for vertical detachment that prevents the accessory from contacting the firearm F. The contact necessitated by conventional mounting devices is problematic because such contact can damage the accessory and/or limit the configuration or size of the accessory to be mounted to the firearm F. For example and with a conventional mounting device that requires accessory pivoting for removal, the diameter of the front and rear bells of a scope S is limited since the bells will make contact with the firearm F during removal. If the either of the bells are too large, the removal process will be hindered or precluded with conventional mounting devices. Because the present apparatus 10 provides for vertical detachment and no rotation or pivotal movement, the dimensions of the accessory, including the bells of the scope S, are not limited. An operator or shooter can apply the releasing force F2 and the detaching force F3 with one hand. For example, the shooter can apply the releasing force F2 with his thumb and then grasp the accessory to provide the detaching force F3 while using his other hand to steady the firearm F.

As the detaching force F3 is applied and the plug 32 vacates the aperture 48, the keeper 60 moves inward towards the aperture 48 and away from the outer base wall 40*e*. The inward movement of the keeper 60 results from the biasing force provided by the compressed spring 86 and continues as the finger 62 extends through the orifice 49 and into the plug slot 34. The biasing force provided by the spring 86 to the keeper 60 is oriented substantially perpendicular to the longitudinal axis A-A of the aperture 48 and B-B of the plug 32. Therefore, the keeper 60 moves left (see FIG. 7) until the inner wall arrangement 52*a, b* constrains further movement of the keeper 60 and the outer keeper wall 60*a* is aligned with the outer base wall 40*e*. Accordingly, the keeper 60 and actuator 80 move in a third direction and then a fourth direction that is opposite the third direction as the plug 32 is removed from the aperture 48 to reach the detached position DP. Since the accessory and attached coupler 20 have been detached, the leading finger portion 62*a* resides within the aperture 48 but does not engage a plug 32. After the apparatus 10 has returned to the initial position, a second accessory, such as a laser aiming module (LAM) having at least one coupler 20 extending therefrom, can be quickly affixed to the firearm F with the mounting apparatus 10. In this manner, the apparatus 10 allows the rapid interchangeability of various accessories to the firearm F. Alternatively, the first accessory is removed and not replaced with a second accessory, wherein the shooter can proceed to aim the firearm via the front sights $F_{FS}$.

Figure 10:
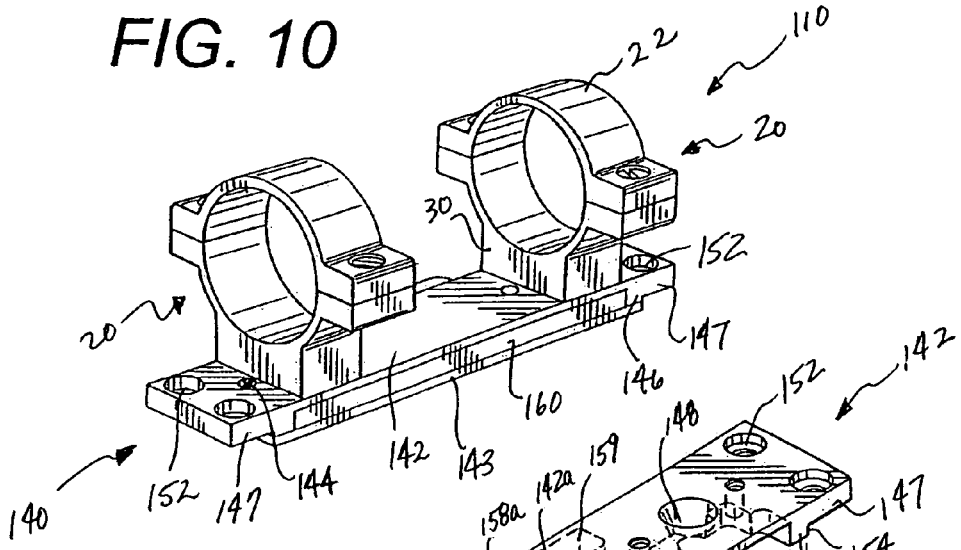
FIG. 10 is a perspective view of an alternate firearm accessory mounting apparatus.
Figure 11:
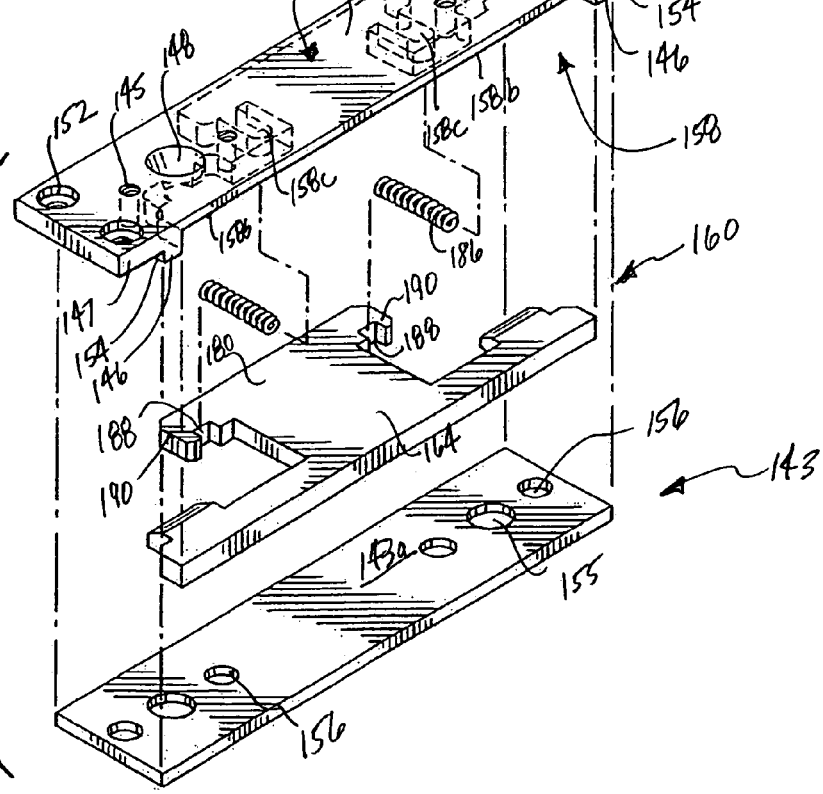
FIG. 11 is an exploded view of the firearm accessory mounting apparatus of FIG. 10, showing a combined keeper and release actuator.

An alternate mounting apparatus 110 is shown in FIGS. 10 and 11. The mounting apparatus 110 includes at least one accessory coupler 20, a base assembly 40 and a keeper 160 with an integrated release actuator 180, where both the coupler 20 and the base 40 are similar to that explained above. Thus, the keeper 60 and the release assembly 80 of the previous embodiment are combined into a single keeper 160 that both secures the coupler 20 and functions as an actuator. Although some structures of the mounting apparatus 110 are different from that of apparatus 10, the operation of the mounting apparatus 110 is consistent with that explained above. The accessory, for example the scope S, can be moved between the initial position, the secured position SP and the detached position DP. Therefore, the apparatus 110 allows for the rapid and precise interchangeability of various accessories to the firearm F without compromising the operation and accuracy of the firearm F. In contrast to conventional devices, the movement to the detached position DP occurs with a purely vertical movement that does not require pivoting of the scope S, or the actuation of levers to detach the scope S from the firearm F.

The base assembly 140 includes an upper elongated member 142 and a lower elongated member 143 that are connected by at least one fastener 144 . The upper member 142 has opposed depending lugs 146 that engage an upper surface of the lower member 143 when the members 142, 143 are connected. The upper member 142 includes an opening 145 that receives an extent of the fastener 144. The upper member 142 further includes at least one aperture 148 that receives the plug 32 of the coupler 20 as explained above for the apparatus 10. Preferably, the aperture 148 is positioned inward of the depending lug 146. In the embodiment of FIGS. 10 and 11, the base 140 includes a pair of lugs 146 and a pair of apertures 148 wherein the apertures 148 are positioned inward of the lugs 146. The upper member 142 has a land or tab 147 external to the lug 146. At least one opening 152 extends through the tab 147 and is configured to receive a fastener (not shown) to secure the apparatus 110 to the firearm F. A notch or step 154 is formed between the lug 146 and the tab 147. The thickness of the upper member 142 varies along its length. For example, the thickness at the lug 146 is greater than the thickness at the tab 147, and the thickness at both of these locations is greater than the thickness at a central member portion 142*a*. Thus, the lug 146 defines the lowermost portion of the upper member 142.

The lower member 143 includes at least one aperture 155 that is cooperatively dimensioned and positioned with the aperture 148 to receive an extent of the plug 32. The lower member 143 further includes a plurality of openings 156 wherein each opening 156 is cooperatively positioned with an opening 145 that receives the fastener 144. Although shown as having a planar configuration, the lower member 143 can have a curvilinear configuration which defines a convex or concave shape. When the base assembly 140 is connected, a lower surface of the lug 146 engages an upper surface 143*a* of the lower member 143. In the mounting configuration of FIG. 1 where the apparatus 110 is secured to the tabs 42, 43, a lower surface 143*b* is positioned above the firearm receiver $F_R$. The lower member 143 has length less than the length of the upper member 142. Preferably, the length of the lower member 143 corresponds to the length or distance between the lugs 146. As such, the lower member 143 does not extend beyond the lug(s) 146 when the upper and lower members 142, 143 are connected. Due to the lugs 146, the upper and lower members 142, 143 define an internal cavity 158 that receives the keeper 160. As shown in FIG. 11, the internal cavity 158 includes a main cavity segment 158*a* that slidingly receives a central portion 164 of the keeper 160 and the actuator 180. As a result, the main cavity segment 158*a* includes an opening in both sides of the base 140. The cavity 158 includes an internal wall arrangement 159 that defines boundaries of the cavity 158. The cavity 158 further includes two peripheral segments 158*b* that each receive an arm 166 and finger 162 of the keeper 160. Preferably, each segment 158*b* includes a recess 158*c* that extends inward into communication with the aperture 148 wherein the recess 158*c* receives an extent of the finger 162.

The keeper 160 is configured to interact with the plug 32 to retain the coupler 20 in the secured position SP. The keeper arm 166 extends outward from the central portion 164 of the keeper 160. The outwardly extending finger 162 includes the frontal or leading edge portion 162*a* outward of a main body portion 162*b*. The geometry of the finger 162 corresponds to that of the finger 62 explained above. In the secured position SP, an extent of the finger 162 is received by the slot 34 to securedly retain the plug 32 within the block 140. The release actuator 180 is joined to the central keeper portion 164 opposite the keeper arm 166. The release actuator 180 is actuated by an operator to allow the apparatus 110 and the accessory to be moved between the secured position SP and the detached position DP. At least one means for biasing the actuator 180, such as a helical spring 186, is positioned between the actuator 180 and the base 40. Specifically, a first end of the spring 186 is received within a receptacle 158*c* of the block cavity 158, and a second end of the spring 186 is received within a well 188 formed by a notch 190 in a peripheral segment of the actuator 180.

Figure 12:
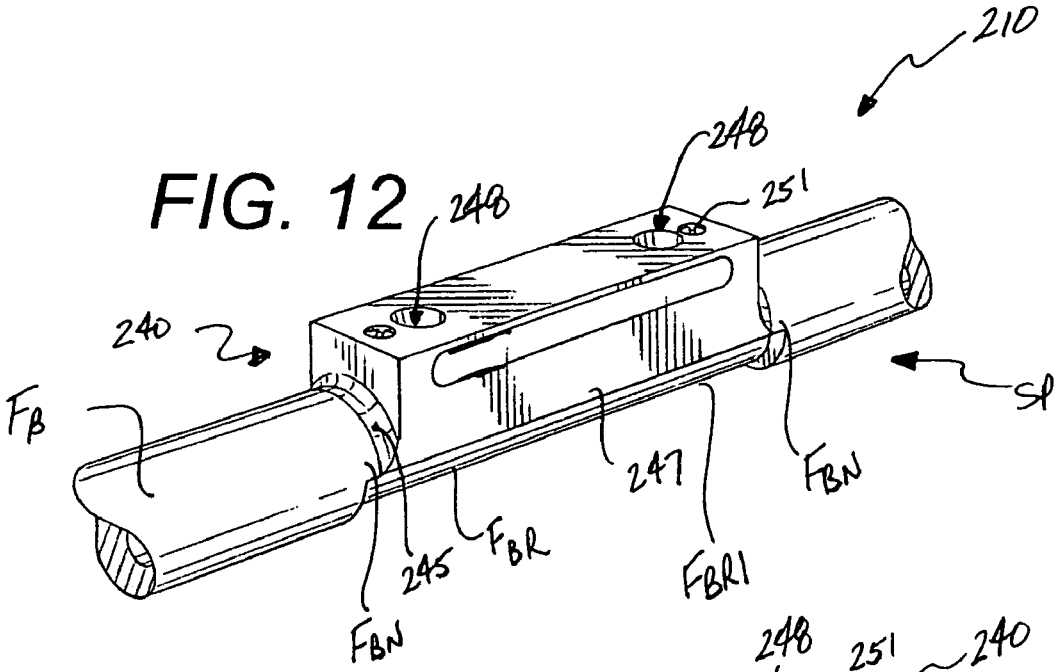
FIG. 12 is a perspective view of an alternate firearm accessory mounting apparatus, showing the mounting apparatus removably affixed to a barrel of a firearm.
Figure 13:
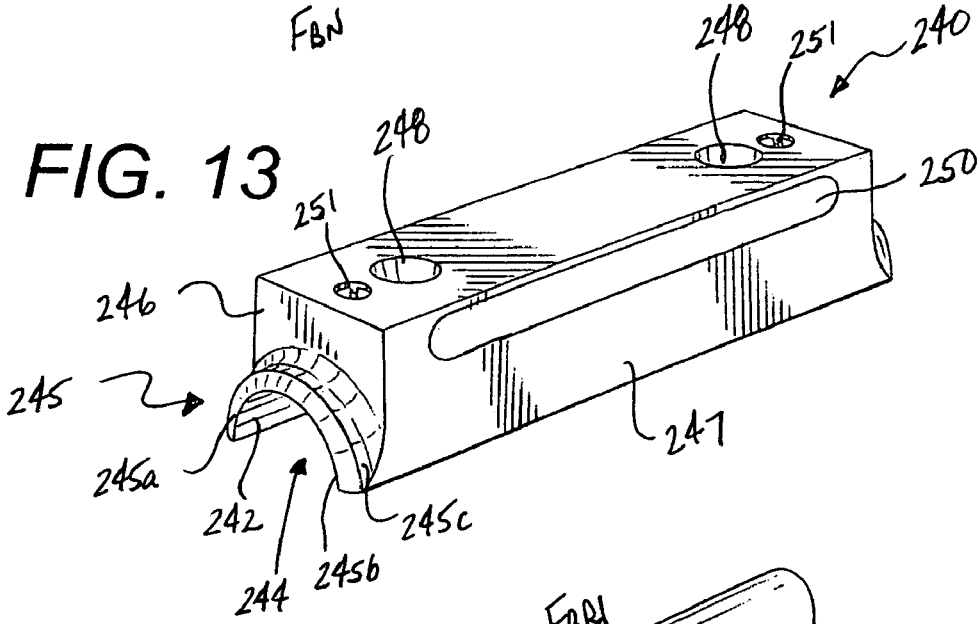
FIG. 13 is a perspective view of the firearm accessory mounting apparatus of FIG. 12.
Figure 14:
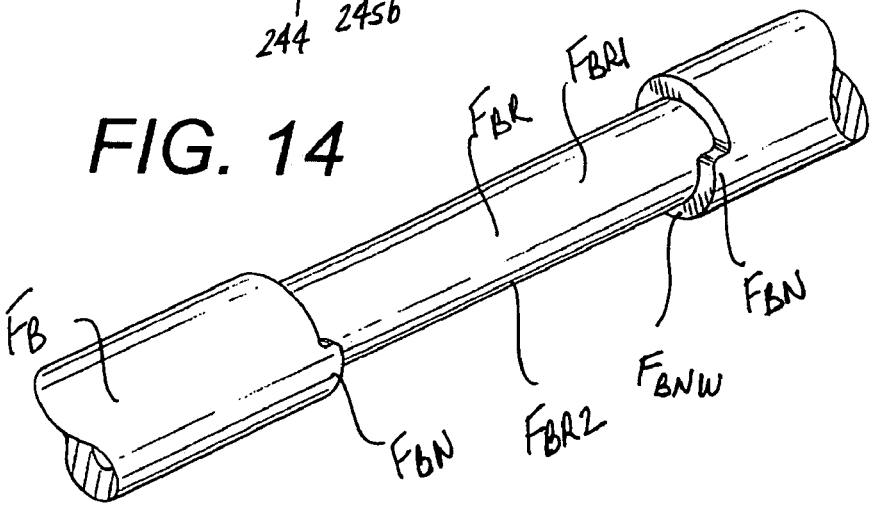
FIG. 14 is a perspective view of the barrel of the firearm to which the firearm accessory mounting apparatus of FIG. 12 is affixed.

FIGS. 12-14 show an alternate embodiment of the mounting apparatus 210 where the base 240 has a curvilinear bottom wall 242 that defines an curvilinear receiver 244 that securedly engages a recessed portion $F_{BR}$ of the firearm barrel $F_B$. Referring to FIG. 13, each end of the receiver 244 has a lip 245 that extends outward from an end wall 246 of the base 240. The lip 245 has an angled front portion 245*a* that defines a leading edge 245*b* of the lip 245. Also, the lip 245 has a top wall 245*c* that leads to the end wall 246. A pair of side walls 247 extend between the end walls 246. Consistent with that explained above, the base 240 includes an aperture 248 and an internal cavity 250 that receives the keeper 60.

As shown in FIG. 14, the recess $F_{BR}$ is circumferential about the barrel $F_B$ and has a depth causing the diameter of the barrel recess $F_{BR}$ to be less than that of the barrel $F_B$. The barrel recess $F_{BR}$ includes opposed notched segments $F_{BN}$ that are spaced a distance corresponding to the overall length of the base 240. To attach the base 240 to the barrel $F_B$, the base 240 is brought into engagement with a first portion of the barrel recess $F_{BR1}$ then rotated, preferably approximately 180 degrees, to a second portion of the barrel recess $F_{BR2}$ between the notches $F_{BN}$, whereby the lip 245 securedly engages the inner wall $F_{BNW}$ of the barrel $F_B$. Once the base 240 reaches the second portion $F_{BR2}$, a secured position SP results (see FIG. 12). During the rotation from the first portion $F_{BR1}$, the notches $F_{BN}$ facilitate the positioning of the lip 245 against the notch $F_{BN}$. In a preferred embodiment, the inner wall $F_{BNW}$ is declined at an angle that corresponds to the angle of incline of the front portion 245*a* wherein the leading edge 245*b* is subsumed. (see FIG. 12). In the context of a firearm F and in the secured position SP, the base 240 is affixed to an upper portion of the barrel $F_B$ which corresponds to the second barrel recess portion $F_{BR2}$, and a lower portion of the barrel $F_B$ is oriented downward. To release the base 240 from the secured position SP, the base 240 is rotated, preferably approximately 180 degrees, from the second portion $F_{BR2}$ to the first portion $F_{BR1}$. In addition, the base 240 can include at least one set screw 251 to further secure the base 240 to the recessed barrel portion $F_{BR}$.

Figure 15:
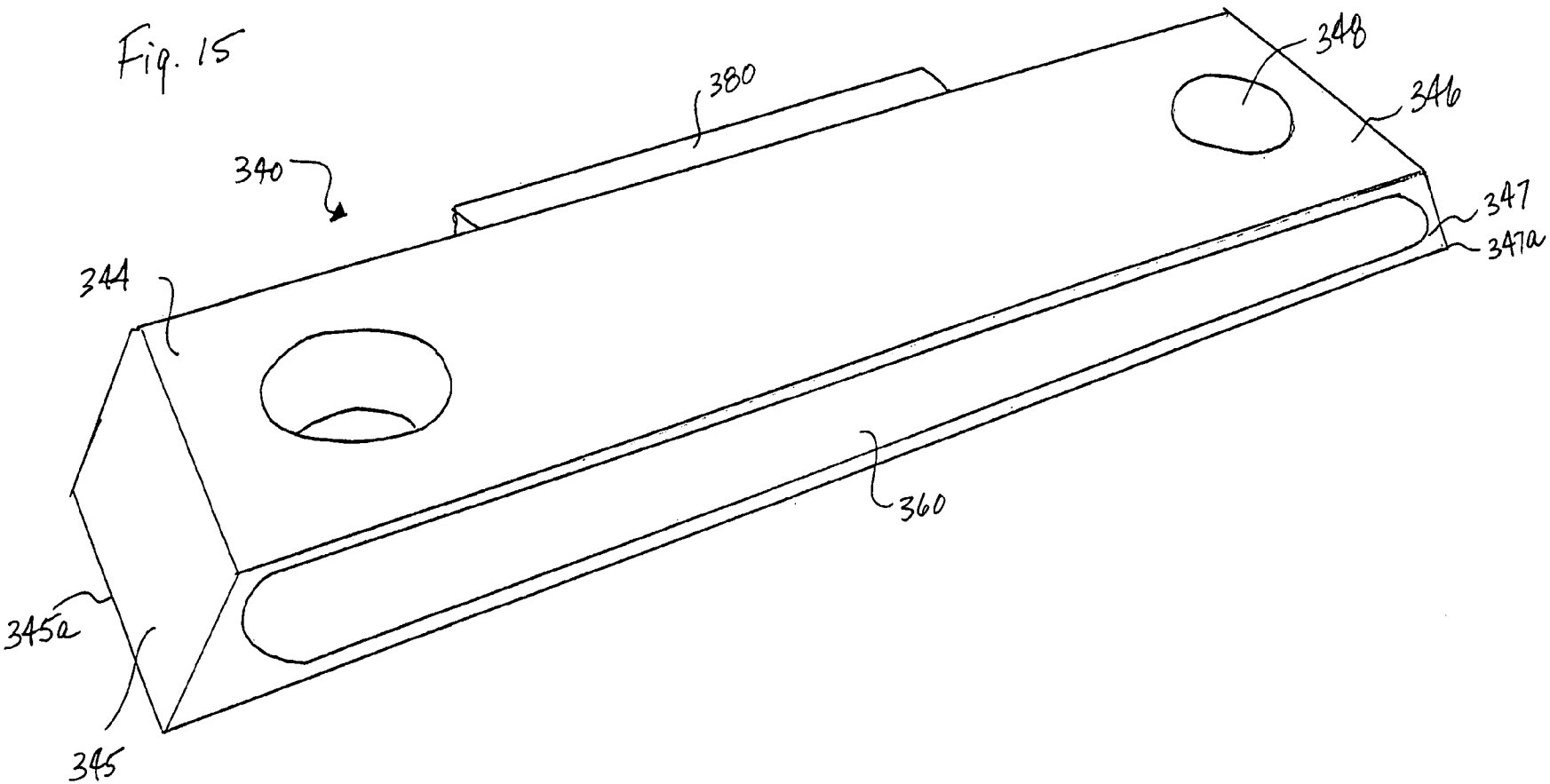
FIG. 15 is a perspective view of an alternate firearm accessory mounting apparatus, showing the base having opposed tenons.
Figure 16:
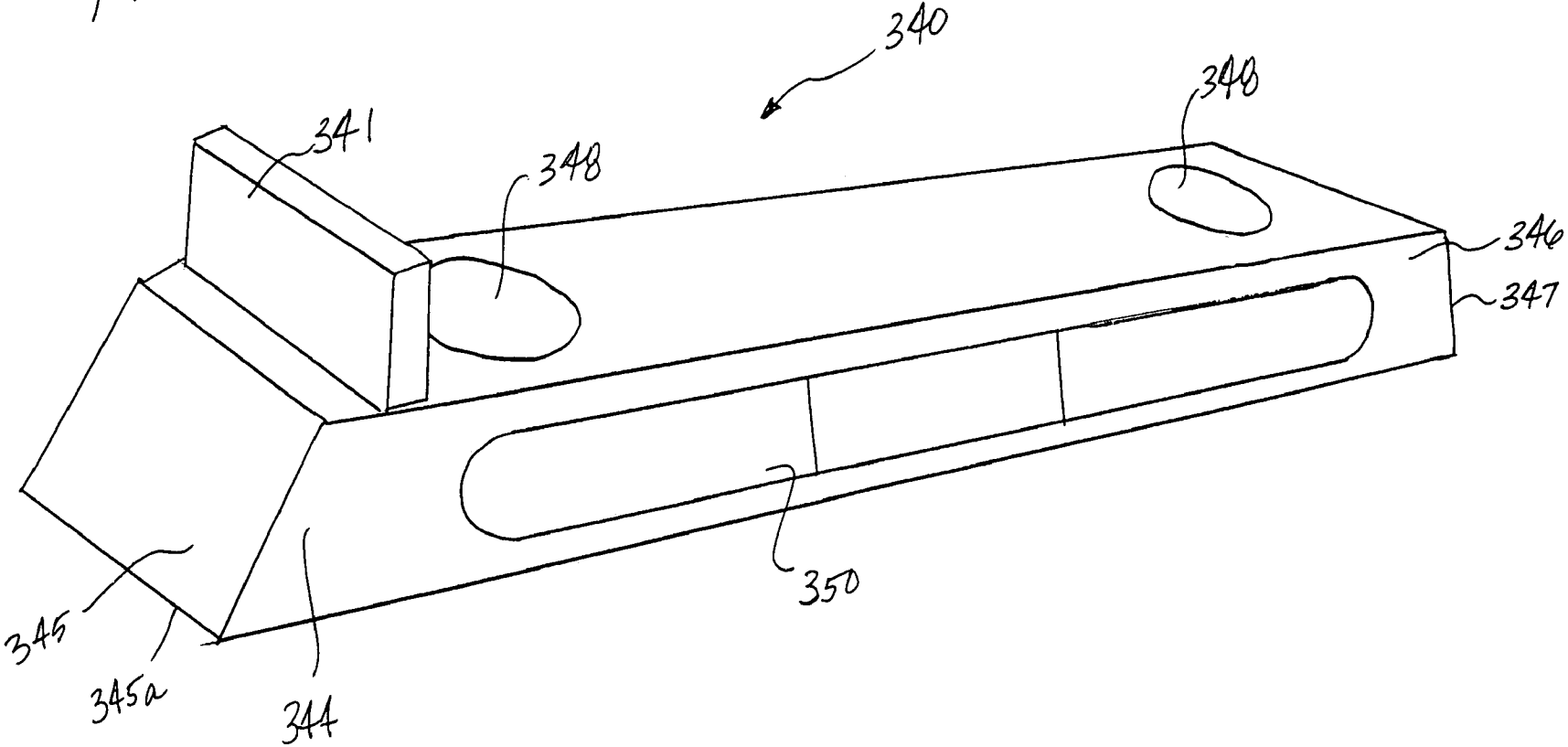
FIG. 16 is a perspective view of the mounting apparatus of FIG. 15, showing the base having an upwardly extending wall.

Another embodiment of the inventive mounting apparatus 10 is shown in FIGS. 15 and 16. There, the base 340 has a front end 344 with a front projection or tenon 345, and a rear end 346 with a rear projection or tenon 347, wherein the tenon 345, 347 defines a "dovetail." The tenons 345, 347 are angled or sloped to form a leading edge 345*a*, 347*a*. The base 340 is received within a slot formed in the firearm F, such as the barrel $F_B$. As an example, the slot is formed in the barrel $F_B$, preferably near the muzzle such that a "scout mount" results. As another example, the slot is formed in either the receiver $F_R$ or the frame of a handgun. The slot has a front mortise and a rear mortise that receive a respective tenon 345, 347. The structural interaction between the tenons 345, 347 and the mortises provides a friction fit to securedly retain the base 340 and the accessory mounted thereto. Although the tenons 345, 347 are shown aligned on a major axis of the base 340, the base 340 can be reconfigured such that the tenons 345, 347 are aligned on a minor axis of the base 340. The mortise that receives the tenons 345, 347 aligned on a minor axis of the base 340 would then be formed in side portions of the slot in the firearm F. The base 340 also includes at least one aperture 348, the internal cavity 350, the keeper 360, and the actuator 380. In FIG. 16, the base 340 has an upwardly extending wall 341 that functions as a sight when the accessory is detached from the firearm F.

Figure 17:
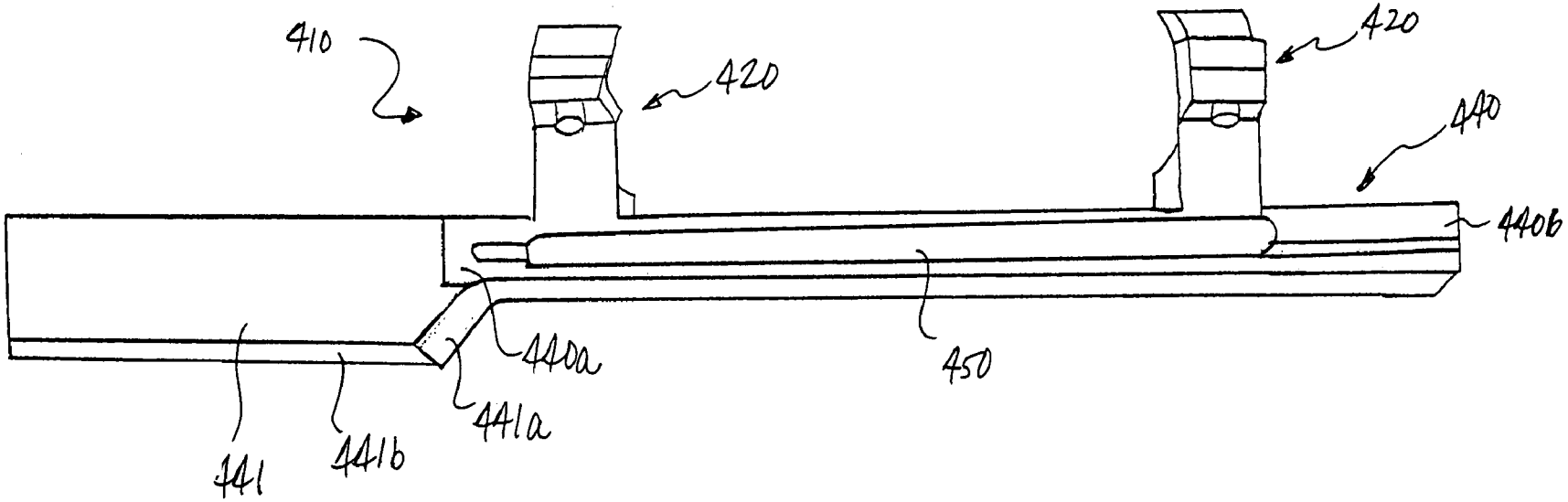
FIG. 17 is a perspective view of an alternate firearm accessory mounting apparatus, showing a cantilever mount structure for the apparatus.

FIG. 17 depicts another embodiment of the invention where the base 440 extends from a support block 441 that is secured to an upper portion of the firearm F, such that the mounting apparatus 10 is positioned above the firearm F. In this "cantilever mount" the support block 441 has a height and a first end 440*a* of the base 440 extends forward from an upper portion of the block 441. A second end 440*b* of the base 440 is free or unsupported. The block 441 includes a substantially vertical transition wall 441*a* that leads from a lower wall 441*b* of the block 441 to the first base end 440*a*. Due to height of the block 441 and the position of the base 440, there is an appreciable gap between the base 440 and the firearm F, such as the receiver $F_R$. The base 440 also includes the couple 420 and the internal cavity 450. The operation of the mounting apparatus 10 having the base 440 and in the cantilever support is consistent with that explained above.

Another embodiment of the inventive mounting apparatus 10 is shown in FIGS. 19-23. There, the apparatus 510 includes a base 540 and a keeper 560 that securedly engages a coupler 20 (not shown) as explained above. The base 540 has a generally rectangular configuration with a closed first end wall 542 and a second wall 544 with an opening 545 that is in communication with an internal cavity 540 that slidingly receives the keeper 560. The base 540 further includes an upper wall 540*a* and a lower wall 540*b*, wherein the upper wall 540*a* includes an opening 546 through which a fastener 547 extends. As explained below, the fastener 547 extends through the base 540 and the keeper 560. The base 540 further includes at least one aperture 548, which is preferably tapered in a manner consistent with the aperture 48 explained above. The aperture 548 is cooperatively dimensioned with the plug 32 of the coupler 20 for reception of the plug 32. A spring 586 is positioned between a first end 560*a* of the keeper 560 and a solid portion 542*a* of the first end 542. The first solid portion 542 includes a well 543 that receives a first portion of the spring 586, and the keeper 560 includes a receptacle 569 that receives a second end of the spring 586. Consistent with that explained above for the apparatus 10, the spring 586 provides a biasing force upon the keeper 560 as the apparatus 510 is moved between the secured position SP, the released position RP and the detached position DP. The well 543 and the receptacle 569 may be omitted, wherein a retention cap is detachably connected to the first end 542 to securedly position the spring 586 against the keeper 560.

Figure 22:
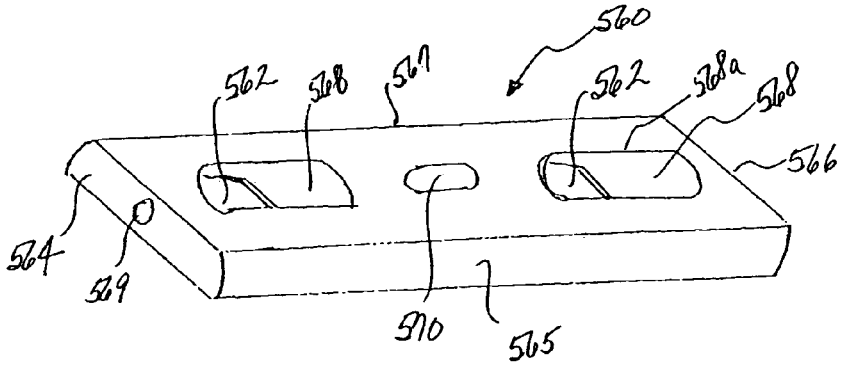
Figure 18:
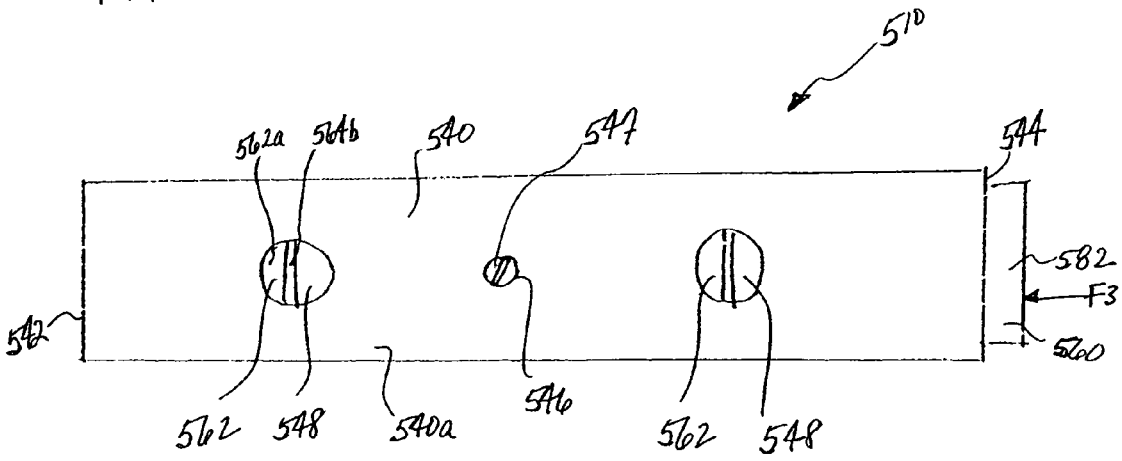
FIG. 18 is

In contrast to the keeper 60, the keeper 560 has a generally rectangular periphery with at least one internal finger 562. The keeper 560 has a first end 564, a second end 566 that extends through the open second wall 544 to define an actuator 582. The keeper 560 also has front wall 565 and a rear wall 567 wherein the front and rear walls 546, 548 are curvilinear (see FIG. 22) to facilitate sliding movement of the keeper 562 within the base 540. Although not shown, the base 540 may have a longitudinal channel cooperatively dimensioned with the curved front and rear walls 565, 567 to guide the movement of the keeper 562. Referring to FIGS. 21 and 22, each finger 562 is positioned with a finger slot 568. Preferably, the finger 562 is recessed or positioned below an upper edge 568*a* of the slot 568 wherein a notch or step-down is formed between the upper edge 568*a* and an upper portion of the finger 562. The finger 562 has a main portion 562*a* and a leading edge 562*b* that is received within the slot 34 of the plug 32 of the coupler 20 in the secured position SP. The leading edge 562 can have a linear, curvilinear or jagged configuration for reception within the plug slot 534. The keeper 560 further includes a central slot 570 that receives the fastener 547.

In operation, the keeper 560 slidingly moves within the cavity 550 of the base 540. When the operator brings the accessory close to the apparatus 10 such that the coupler plug 32 extends into the aperture 548, the finger 562 is received within the plug slot 534 to arrive at the secured position SP. To bring the apparatus 510 to the released position RP, an inwardly directed releasing force F3 is applied to the actuator 582. The release force F3 causes the keeper 560 to move inward of the cavity 550 and towards the first wall 542, thereby compressing the spring 586. This movement disengages the keeper finger 562 from the plug slot 534 to arrive at the released position RP. As the accessory and the coupler 20 are elevated from the base 540 to reach the detached position DP, the plug 32 exits the aperture 548. Since the finger 562 is disengaged or released from the slot 34, the finger 562 does not prevent removal of the plug 32. Because the coupler 20 and the plug 32 remain stationary and the keeper 560 is displaced, the keeper slot 568 is dimensioned to accommodate sliding movement of the keeper 560 about the plug 32. Similarly, the central slot 570 is dimensioned to accommodate sliding movement of the keeper 560 about the fastener 547.

While the specific embodiments have been illustrated and described, numerous modifications come to mind without significantly departing from the spirit of the invention, and the scope of protection is only limited by the scope of the accompanying claims.

What is claimed is:

1. A mounting apparatus for releasably securing an accessory to a firearm, the mounting apparatus comprising:

a coupler connectable to the accessory and having a downward tapered plug extending from a main body portion, the plug having a slot that extends inward from an outer wall of the plug;

a support base having an internal cavity extending between opposed side walls of the base, the support base further having an aperture with an internal wall arrangement including an orifice, the aperture being cooperatively dimensioned with the plug for reception of the plug;

a keeper slidably positioned within the internal cavity, the keeper having opposed arms that extend from a central portion of the keeper, wherein each arm has a finger that extends through the orifice and into the slot to retain the plug within the aperture;

a release assembly having an actuator operably connected to the keeper, wherein the application of a release force to the actuator displaces the finger from the slot thereby permitting removal of the plug from the aperture.

2. The mounting apparatus of claim 1, wherein the release assembly includes a means for biasing the actuator, the biasing means positioned between the actuator and an internal wall of the base.

3. The mounting apparatus of claim 1, wherein the diameter of an upper portion of the plug is greater than the diameter of a lower portion of the plug.

4. The mounting apparatus of claim 3, wherein the aperture has a downward taper wherein the diameter of an upper portion of the aperture is greater than the diameter of a lower portion of the aperture.

5. The mounting apparatus of claim 1, wherein the aperture extends between an upper wall of the base and a lower wall of the base.

6. The mounting apparatus of claim 1, wherein the coupler includes an upper ring segment and a lower ring segment that collectively define a receiver, the receiver engaging an outer surface of the accessory.

7. The mounting apparatus of claim 1, wherein the slot includes a horizontal upper wall, a vertical internal wall and a sloped lower wall.

8. The mounting apparatus of claim 1, wherein the keeper and the finger move in direction substantially perpendicular to a longitudinal axis of the plug.

9. The mounting apparatus of claim 1, wherein the finger has a leading portion with an inclined upper surface, and wherein the leading portion extends through the orifice and into the slot to retain the plug within the aperture.

10. A mounting apparatus for releasably securing an accessory to a firearm, the mounting apparatus comprising:

an accessory coupler having a plug extending from a main body portion, the plug having an inwardly extending slot;

a support base having an internal cavity extending between opposed side walls of the base, the base further having an aperture cooperatively dimensioned with the plug for reception of the plug, the aperture having an internal wall arrangement with an orifice;

a keeper slidably positioned within the internal cavity, the keeper having a central portion and an outwardly extending arm with a finger;

an actuator slidably positioned within the internal cavity and operably connected to the keeper;

the apparatus being moveable between a secured position wherein the finger extends through the orifice and into the slot to retain the plug within the aperture, and a released position wherein the finger exits the slot and aperture by passing through the orifice, and wherein the application of an inwardly directed releasing force to the actuator moves the apparatus from the secured position to the released position.

11. The mounting apparatus of claim 10, wherein the release assembly includes a means for biasing the actuator, the biasing means positioned between the actuator and an internal wall of the base.

12. The mounting apparatus of claim 10, wherein the plug has a downward taper whereby the diameter of an upper portion of the plug is greater than the diameter of a lower portion of the plug.

13. The mounting apparatus of claim 10, wherein the releasing force is applied in a direction that is substantially perpendicular to a longitudinal axis of the plug.

14. The mounting apparatus of claim 10, wherein the releasing force is applied in a direction that is substantially perpendicular to a longitudinal axis of the aperture.

15. A mounting apparatus for releasably securing an accessory to a firearm, the mounting apparatus comprising:

a coupler connectable to the accessory and having a plug extending from a main body portion, the plug having a slot that extends inward from an outer wall of the plug;

a support base having an internal cavity extending between opposed side walls of the base, the base further having an aperture cooperatively dimensioned with the plug for reception of the plug, the aperture having an internal wall arrangement with an orifice;

a keeper slidably positioned within the internal cavity, the keeper having a central portion with an extending arm and a finger extending from the arm, wherein the finger extends through the orifice and into the slot to retain the plug within the aperture; and, the apparatus being moveable between a secured position wherein the finger extends through the orifice and into the slot of the plug positioned within the aperture, and a released position wherein the finger is disengaged from the orifice, and a detached position wherein the coupler and the accessory are removed from the base.

16. The mounting apparatus of claim 15, wherein the apparatus is moved between the secured position and the released position by the application of a releasing force to the keeper.

17. The mounting apparatus of claim 16, wherein the releasing force is directed substantially perpendicular to a longitudinal axis of the aperture.

18. The mounting apparatus of claim 15, wherein the apparatus is moved between the released position and the detached position by the application of a detaching force to the firearm accessory.

19. The mounting apparatus of claim 18, wherein the detaching force is applied in a direction that is substantially parallel to longitudinal axis of the aperture.

20. The mounting apparatus of claim 15, wherein the both the aperture and the plug have a downward taper whereby the diameter of an upper portion is greater than the diameter of a lower portion.

* * * * *